US006494017B1

(12) United States Patent
McGrath et al.

(10) Patent No.: US 6,494,017 B1
(45) Date of Patent: Dec. 17, 2002

(54) MULTI-FUNCTION IN-CASE FILLING AND CAPPING SYSTEM

(76) Inventors: Timothy McGrath, 2009 Dumont Rd., Timonium, MD (US) 21093; John G. Grosskopf, 10081 Whitworth Way, Ellicott City, MD (US) 21042

( * ) Notice: Subject to any disclaimer, the term of this patent is extended or adjusted under 35 U.S.C. 154(b) by 128 days.

(21) Appl. No.: 09/616,452

(22) Filed: Jul. 14, 2000

Related U.S. Application Data

(63) Continuation-in-part of application No. 09/134,599, filed on Aug. 14, 1998, now abandoned.
(60) Provisional application No. 60/055,776, filed on Aug. 15, 1997.

(51) Int. Cl.[7] ..... B65B 3/04; B65B 7/28; B65B 57/00
(52) U.S. Cl. ..... 53/53; 53/282; 53/284.5
(58) Field of Search ..... 53/53, 55, 202, 53/282, 284.5, 471

(56) References Cited

U.S. PATENT DOCUMENTS 3,270,487 A * 9/1966 Tchimenogolov ..... 53/282
3,775,934 A * 12/1973 Smith ..... 53/282
4,020,881 A * 5/1977 Nothen ..... 53/282
4,151,698 A * 5/1979 Muller ..... 53/282
4,693,052 A * 9/1987 Rebmann ..... 53/282
4,756,137 A * 7/1988 Lanigan ..... 53/202
4,922,687 A * 5/1990 Chow ..... 53/282
4,936,072 A * 6/1990 Creed ..... 53/282
5,195,294 A * 3/1993 Baranowski ..... 53/282
5,301,488 A * 4/1994 Ruhl ..... 53/55
5,419,099 A * 5/1995 Mueller ..... 53/55

* cited by examiner

*Primary Examiner*—John Sipos
(74) *Attorney, Agent, or Firm*—Law Offices of Royal W. Craig

(57) ABSTRACT

An improved process and configuration for multi-function in-case filling and capping.

A multi-lane embodiment is provided in which cases of empty containers are received from one or more upstream conveyor loading processes. Each case's major and minor flaps are opened, and each case is directed to flap control rails for maintaining the flaps in an open position throughout the filling and capping process. Each open case is inspected to confirm that the containers are present and are properly oriented within each case, while any improperly loaded cases are rejected from the system. The cases are then diverted into the least backlogged of a series of processing lanes, where the individual containers are filled. Screw thread caps or other closures are then applied to the containers, and the cases of filled containers converge back together in a single discharge lane.

In another embodiment, an improved transfer efficiency of containers is achieved by filling the containers on the fly, and concurrent capping of multiple containers, thereby reducing the conveyor time between stations.

8 Claims, 22 Drawing Sheets

MULTI-FUNCTION IN-CASE FILLING AND CAPPING SYSTEM

CROSS-REFERENCE TO RELATED APPLICATIONS

The present application is a continuation-in-part of U.S. patent application Ser. No. 09/134,599, filed May 14, 1998 now abandoned by Bennett et al. for their "MULTI-FUNCTION IN-CASE FILLING AND CAPPING SYSTEM", which application was based on U.S. provisional application serial No. 60/055,776 filed on Aug. 15, 1997.

BACKGROUND OF THE INVENTION

1. Field of the invention

The present invention relates to automated high-volume in-case filling and capping of containers and, more particularly, to an improved process and configuration for single or multiple lane, multi-function in-case filling and capping.

2. Description of the Background

The filling and capping process generally entails supplying bottles, containers, or cases containing bottles/containers along a conveyor, automatically filling them at a filling station, and automatically capping them at capping stations. Various testing and control functions may be performed along the way, for instance, testing and control of fill volume, cap torque, conveyor velocity, etc. The apparatus which performs the process must be capable of accommodating a wide variety of containers since they can vary in size, shape, neck angle, etc.

Existing filling and capping systems incorporate both rotary and linear machines. See, e.g., U.S. Pat. No. 5,301,488. In linear intermittent-motion machines, the containers are typically halted at each station for processing and/or testing. Thus, the throughput of such machines is limited by the capabilities of each station, and bottlenecks at any station can limit the total throughput.

U.S. Pat. No. 3,270,487 to Tchimenoglov is another early in-case filling and capping apparatus. Tchimenoglov et al. '487 shows a carrier 16 that transports cases from station to station (column 2, lines 56 et seq.), and a jig 36 mounted on the carrier 16 that clamps and lifts the bottles out of their cases at each station (column 2, lines 62–64). At each station the caseload of containers is held in a fixed position for the respective operations (filling, capping, etc.). There is no continuous-motion throughout the circuit nor tandem processes performed on multiple containers during the continuous-motion.

U.S. Pat. No. 5,419,099 to Mueller et al. shows a computerized system for filling containers I with food products. The system is designed to index individual containers by the use of a servo motor-driven conveyor assembly. Again the filling process is single-file and intermittent in nature. As with Tchimenoglov et al. '487, there is no teaching or suggestion of continuous-motion throughout the circuit, and the system is not capable of it. Moreover, there is no teaching or suggestion of tandem processes performed on multiple containers during the continuous-motion.

As an alternative to the foregoing linear devices, rotary machines work in a continuous motion, thereby providing increased filling and capping throughput. There have been efforts to increase the efficiency of the individual stations for both linear and rotary machines. For example, U.S. Pat. No. 5,301,488 to Ruhl et al. discloses a turret system for servo motor-operated intermittent indexing, filling, plugging, and capping functions. As stated at column 4, lines 48–53, a high-speed indexing turret positions the containers. The containers stop at two successive positions, first while a high-speed filling pump fills two-thirds of the container, and then while a second slower pump tops it off. (column 4, lines 59–64). Once again, the filling and capping process is single-file and intermittent in nature. There is no teaching or suggestion of continuous-motion throughout the circuit, and the system is not capable of it. Indeed, the extreme logistics of routing and then recombining containers in a rotary system prevents tandem processes performed on multiple containers during continuous-motion.

Clearly, there remains the potential for higher efficiencies and increased productivity, and it would be greatly advantageous to provide an apparatus capable of continuous motion and tandem operation using servo-mechanics plus software coordination between the filling and capping stations.

SUMMARY OF THE INVENTION

It is, therefore, an object of the present invention to provide improved processes and configuration for industrial filling and capping applications with greatly improved production rates over those that have been previously available.

It is another object of the present invention to provide a process and configuration for multiple-lane in-case filling and capping.

It is still another object to improve the station-to-station transfer efficiency in each lane of a multi-function in-case filling and capping system.

It is yet another object of the present invention to provide an improved process and configurations for multi-function in-case filling and capping which incorporates a quality control mechanism whereby fill volumes in each container may be monitored and reported, and whereby cap application and removal torque may also be monitored and reported.

In accordance with the above objects, one embodiment of an improved process and apparatus for multi-lane, multi-function in-case filling and capping of containers is provided in which cases of empty containers are received from an upstream conveyor loading process. Each case's major and minor flaps are opened, and each case is directed to flap control rails for maintaining the flaps in an open position throughout the filling and capping process. Each open case is inspected to confirm that the containers are present and are properly oriented within each case, while any improperly loaded cases are rejected from the system. The properly loaded or configured cases are then diverted into the least backlogged of a series of processing lanes, where the individual containers are filled. Screw thread caps or other closures are then applied to the containers, and the cases of filled and capped containers converge back together in a single discharge lane.

In another embodiment, the transfer efficiency of containers is improved by filling and capping the containers continuously, thereby making container/case indexing concurrent with the filling and capping processes, and increasing overall throughput.

BRIEF DESCRIPTION OF THE DRAWINGS

Other objects, features, and advantages of the present invention will become more apparent from the following detailed description of the preferred embodiments and modifications thereof when taken together with the accompanying drawings in which.

DETAILED DESCRIPTION OF THE PREFERRED EMBODIMENTS

Figure 1:
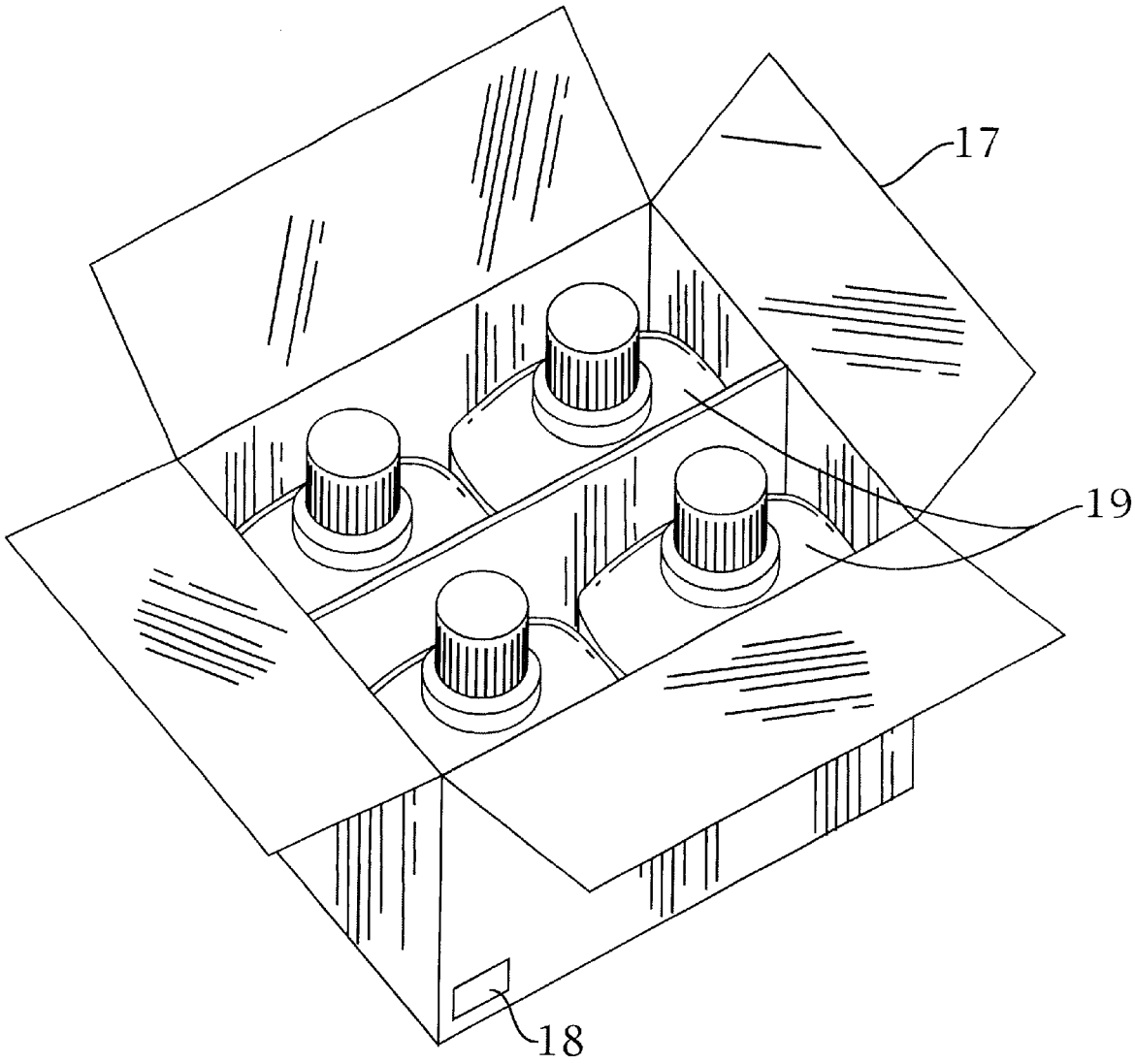
FIG. 1 is a top perspective view of a conventional corrugated cardboard case 17 of the type that typically incorporates two or four containers 19 to be filled and capped by the system of the present invention.
Figure 2:
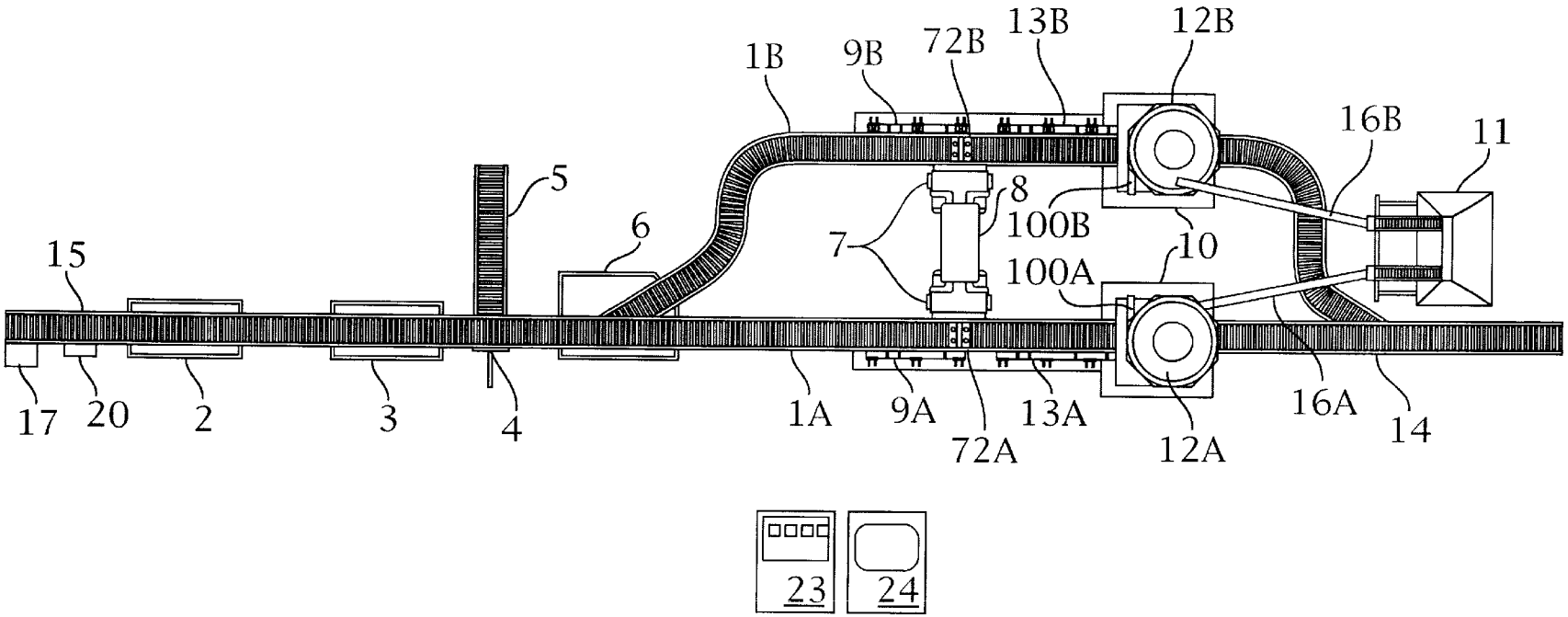
FIG. 2 is a top perspective view of a multi-lane multi-function in-case filling and capping apparatus according to one embodiment of the present invention.

FIG. 1 is a top perspective view of a typical corrugated cardboard case 17 incorporating four containers 19 of the type to be filled and capped by the system of the present invention. Groupings of containers 19 are seated in the cardboard case 17 in rows and may be separated by dividers. A. bar code 18 appears on the case itself, and the bar code 18 contains information about the cardboard case 17 and containers 19 situated therein such as product size, number and cap type. Each filling and capping job generally begins with adjustment of the equipment to handle a number of identical cases and containers, and the bar codes are used to insure uniformity. The present system will be described herein with reference to the illustrated containers, which have large measuring caps. However, it should be understood that the system and apparatus may readily be adapted for other case sizes and bottle or container arrangements, and other bottle or container types such as vials, sample receptacles and the like FIG. 2 is a top perspective view of a two-lane, multi-function in-case filling and capping apparatus according to one embodiment of the present invention. The device is designed for automated high-volume filling and capping of containers 19 in cardboard cases 17 such as described above.

The cases 17 containing the empty containers 19 are placed at the start of a system conveyor 15 from the loading dock. Each empty case enters the system from the left and is conveyed through the system (from left to right) via the system conveyor 15. System conveyor is a conventional track and roller-type conveyor fabricated from mild steel, and it supports the cases/containers throughout the process. There are a number of track and roller-type conveyors that are commercially available from, for example, Materials Handling Systems, Inc. (MHS) of Elkridge, Md., or AMBEC, Inc. of Owings Mills, Md. Other available conveyors may be equally well-suited for use in the present system.

The cases 17 are conveyed past a conventional bar code reader 20 which scans the bar code 18 (on the case 17). Given the bar-coded information it is possible to verify case orientation at the optical inspection station 3 (to be described), as well as the contents to be dispensed. Bar code reader 20 is connected to a programmable logic controller ("PLC") 23 with attached display output 24. The bar-coded information is used to verify that each case entering the filling and capping areas matches the setup parameters of the equipment, such as fill volume and cap torque. Further, in a fully automated in-case filling and capping system, the bar code reader 20 can be used to initiate servo-operated setup and changeover processes whereby the system operation may be adjusted as necessary to provide for different filling and capping applications. In a typical semi-automated system, the scanned bar code information is displayed to provide the system operator with a checklist of the required manual changeover steps on an operator interface screen. There are a number of suitable bar code readers that are commercially available from, for example, Omron Electronics of Schaumburg, Ill.

If the bar code reading is acceptable, the case 17 proceeds along conveyor 15 to a flap opener 2. The flap opener 2 (described more fully below) automatically opens all four flaps of the case.

From the flap opener 2 as shown, the case proceeds to an optical inspection station 3. Optical inspection station 3 includes a commercially available camera or vision system, positioned directly above conveyor 15. A suitable vision system is commercially available from Omron Electronics of Schaumburg, Ill., and this may be connected directly to PLC 23. Optical inspection station 3 also incorporates mechanical means for centering cases 17 during inspection, and for ejecting any non-conforming cases. A typical case positioning mechanism comprises a pivoting gate or stop finger, and ejection can be accomplished via a simple pusher bar assembly 4 which moves the non-conforming cases onto a rejected case collection conveyor 5. Case collection conveyor 5 is a section of conventional track and roller conveyor positioned perpendicularly to conveyor 15. A variety of acceptable gates, stop fingers, and pusher bar assemblies are commercially available, and these are connected to the PLC 23 for actuation thereby. Each open case is positioned in optical inspection station 3 where the vision system above inspection station 3 determines whether any containers are missing from the case, whether any pouring spouts are missing from the containers, and whether any containers are not properly oriented within the case. It is noteworthy that containers may have offset necks, and therefore orientation can be very important. Cases that fail at optical inspection station 3 due to the existence of any of the aforementioned conditions are rejected. This is accomplished by urging the failed cases off the system conveyor 15 by automatic pusher bar assembly 4. The rejected cases are accumulated on case collection roller conveyor 5. If the problem is corrected, the case can later be readmitted to the system (in front of the bar code reader 20).

Cases that successfully pass at the optical inspection station 3 travel toward one of the parallel processing lanes 1A and 1B via a case directing system 6. The conveyors of lanes 1A and 1B are off-shoots of conveyor 15, and are likewise preferably fabricated of stainless steel with nylon rollers on stainless shafts, such that the conveyors of processing lanes 1A and 1B may be washed down in the event of product spillage.

The case directing system 6 is also connected to programmable logic controller (PLC) 23 which controls the direction of each case to the one of lanes 1A or 1B that has the least backlog of cases for processing.

The PLC 23 likewise directs the overall in-case filling and capping process, including setup parameters, diagnoses of fault conditions, sensing the level of caps in each prefeeder bin, monitoring of all sensors along the processing line, as well as the filling and capping operations themselves. A suitable PLC 23 is commercially available as the Allen-Bradley Model PLC-5/40, and this is preferably connected to a PC-based human/machine interface (HMI) display 24 which provides a full visual operator interface (an Allen-Bradley PanelView 900 is a suitable commercial HMI display). To coordinate and synchronize the operation of all active components, all of the following components are connected to the PLC 23: bar code reader 20, flap opener 2, optical inspection station 3, case directing system 6, first case indexing assemblies 9A and 9B, dual lane filling apparatus 7, second indexing assemblies 13A and 13B, in-process quality control system, and dual lane capping apparatus 10. Thus, the PLC 23 controls the entire program flow. The Allen-Bradley PLC 23 used herein includes a serial communication port (RS-232) by which it can be interfaced directly to a conventional personal computer to provide further control flexibility.

Figure 3:
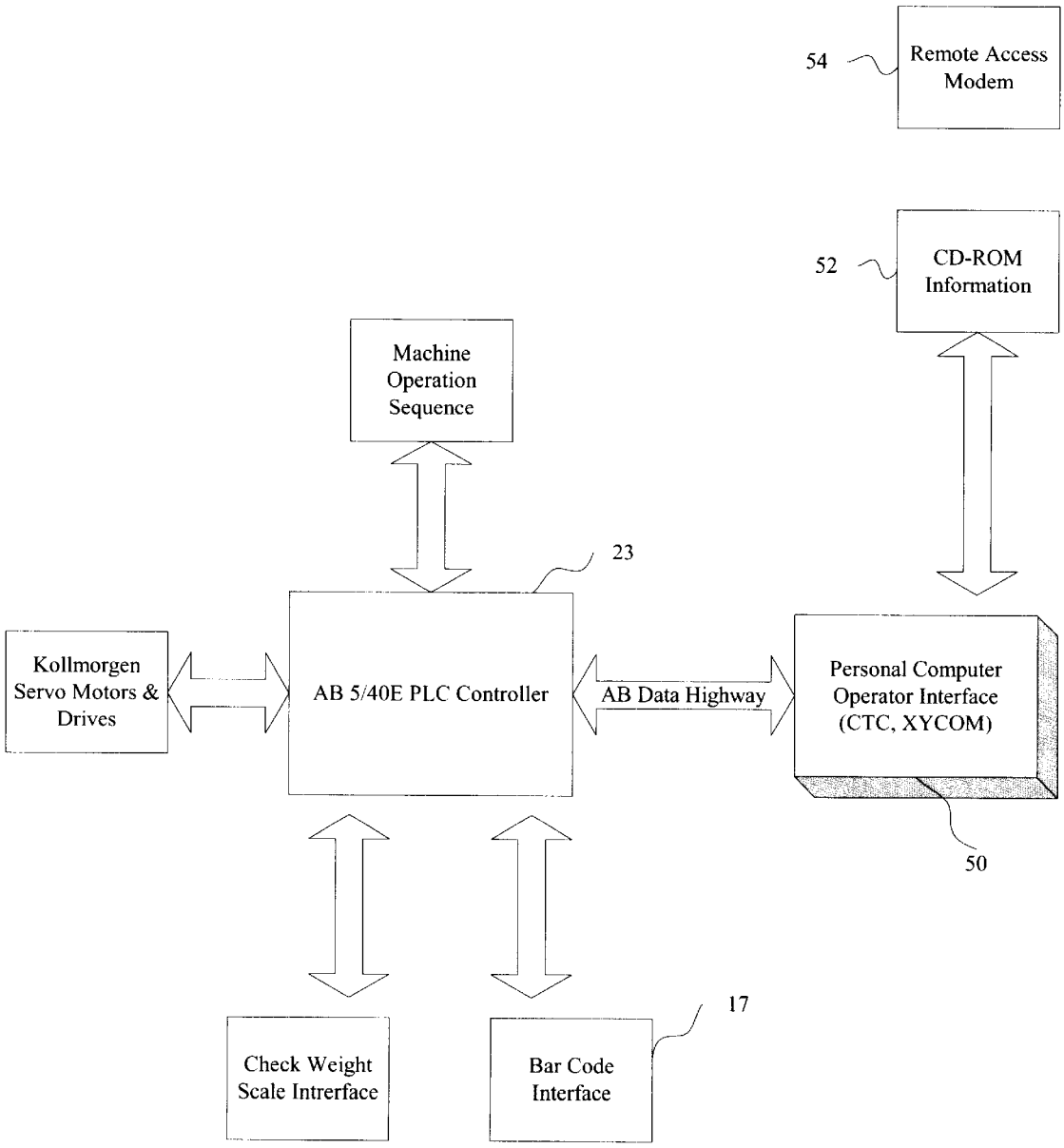
FIG. 3 is a block diagram illustrating how the PLC 23 interfaces with the other components and an optional personal computer.

FIG. 3 is a block diagram illustrating how the PLC 23 interfaces with the above-named components including a personal computer 50. The personal computer 50 is shown with connections to preferred peripheral components such as a conventional CD-ROM drive 52, and a remote access modem 54. The CD-ROM 52 allows instant access to a software instruction manual (with graphics and video clips) and other software help resources, and the modem 54 facilitates online communications for remote debugging or remote control of the entire system.

The computer can also be loaded with existing statistical process control software (SPC) such as RSView32 from Rockwell Software, Inc. of West Allis, Wis. to provide a graphical user interface and statistical output for closer control of the process.

Referring back to FIG. 2, case directing system 6 preferably is a skewed-wheel diverter commercially available from Roach Manufacturing Corporation, although other directing systems may be used. Each case enters case directing system 6 and is allowed to either proceed along the main conveyor lane 1A or is diverted onto the secondary conveyor lane 1B. Each of lanes 1A and 1B will direct the case to their respective filling process stations where they are filled by a dual-lane filling apparatus 7. If for any reason one of the filling or capping machines becomes inoperable, all of the cases are directed onto the conveyor lane 1A or 1B of the filling and capping system that remains functional.

Once the case enters either lane 1A or 1B (prior to arrival at dual-lane filling apparatus 7), the case proceeds to a respective case indexing assembly 9A or 9B. The first (filling area) case indexing assemblies 9A and 9B are each a continuous cleated servo-driven belt spanning the length of the filling area, the cleats of which engage each case to move it along system conveyor 15. First case indexing assemblies 9A and 9B are each driven by conventional servos that are available from, e.g., Kollmorgen, Inc. of Radford, Va. The case indexing assembly 9A or 9B transports the case (under PLC 23 control) into the proper filling position under the tandem nozzles 72A and 72B of the filling apparatus 7, and then transfers the case into respective capping area indexing assemblies 13A and 13B after the filling operation has been accomplished. Containers 19 are located in proper alignment below the tandem nozzles 72A and 72B, while a bar pushes on the outside surface of the case to drive it against a fixed stop positioned on the side of the conveyor that is closest to the frame of the filling machine 7. The tapered tips of the tandem nozzles are sufficient to locate, or align, the neck openings of the containers 19 in the case during the filling process, and this maintains the containers themselves in proper alignment directly below the respective filling nozzles 72A and 72B.

Following proper placement of the containers 19 under the filling nozzles 72A and 72B, the nozzles are lowered into the openings of the containers. Air-operated valves in the tips of the nozzles open and the correct volume of liquid is dispensed. Servo-driven rotary lobe volumetric filling pumps are used to dispense the liquid into the containers, and suitable pumps are commercially available from Waukesha Co. Fluid Handling of Delavan, Wis., under its rotary piston pump line. After the containers 19 are properly filled, the nozzles close. A vacuum suck-off system located in the tip of the nozzle is actuated to control any drips. The nozzles are then lifted out of the containers. Suitable filling nozzles 72A and 72B including vacuum suck-off systems are commercially available from the National Instrument Company, Inc. of Baltimore, Md., and these may be arranged in tandem groups of 2 or 4, one group per line 1A and 1B.

An in-process quality control system is preferably incorporated to automatically determine inappropriate fill volumes which may then be adjusted automatically or by a system operator, and also to provide a measurement of the gross weight of each full case at the conclusion of each fill cycle. For this purpose, a conventional check-weight scale is located in the filling area and, on demand (at user-defined timed intervals), rises up under an empty case. Such check-weight scales are commercially available from, e.g., Mettler-Toledo, Inc. of Hightstown, N.J. In this manner the case can be tare-weighed. A test routine can be run in which a single filling pump is actuated and the fill volume delivered into a single container. The total weight will be tested, and a second container will then be filled and the overall weight determined. Each container in the case is individually filled and weighed, then the individual container weights are determined. If any of the fill volumes are out of specification because of a temperature change, a viscosity change or a change in specific gravity, the pump is automatically re-calibrated by the PLC 23 system. A servo is used to register the correct number of counts corresponding to the correct fill volume. Pump errors are flagged and the operator is notified.

After the filling operation is complete, the filled case is transferred by the first indexing system 9A and 9B to second capping area indexing assemblies 13A and 13B, and onward to dual As with filling area indexing assemblies 9A and 9B, the capping area indexing assemblies 13A and 13B are each a continuous cleated servo-driven belt spanning the length of the capping area, the cleats of which engage each case to move it along system conveyor 15. The capping area indexing assemblies 13A and 13B are also driven by conventional servos.

Each of the two cappers in assembly 10 is preferably a multi-spindle capping machine that is supplied with caps by a cap feeding/orientation system. The presently preferred capper is a Capamatic™ two spindle/capping chuck model that is commercially available from the National Instrument Company, Inc. of Baltimore, Md. The cap feeding/orientation system includes a common prefeeder assembly 11, chutes 16A and 16B, and rotary cap feeder bowls 12A and 12B. At each capper of assembly 10, caps are fed out of the common prefeeder assembly 11. Prefeeder assembly 11 stores the caps to be used, and a thirty-cubic foot capacity is suitable. Caps are transferred by prefeeder assembly 11 down one of two chutes 16A or 16B into rotary feed bowls 12A and 12B. Rotary feed bowls 12A and 12B orient the caps and feed them into chutes 100A and 100B. The entire cap feeding/orientation system (inclusive of prefeeder assembly 11, chutes 16A and 16B, and rotary cap feeder bowls 12A and 12B) is commercially available from Farason Corp. of Coatesville, Pa.

Chutes 100A and 100B deliver the caps to respective splitter plates each comprising a shallow guide plate with forked grooves for dividing caps between two transfer stations. The two capping chucks at each of the two cappers in assembly 10 pick up the caps from the respective transfer stations in each of the two splitter plates.

It has been found that the weight of the filled containers 19 resting on the uneven, internal surface of the bottom of the case results in a slight misalignment between the necks of those containers 19 and the two capping chucks present in each of the two cappers in assembly 10. The misalignment is sufficient, however, to cause the capping mechanism to fail to correctly apply the caps to an intolerably high percentage of containers. To remedy this problem, an alignment mechanism is attached beneath each of the two capping chucks present in each of the two cappers in assembly 10.

Figure 4:
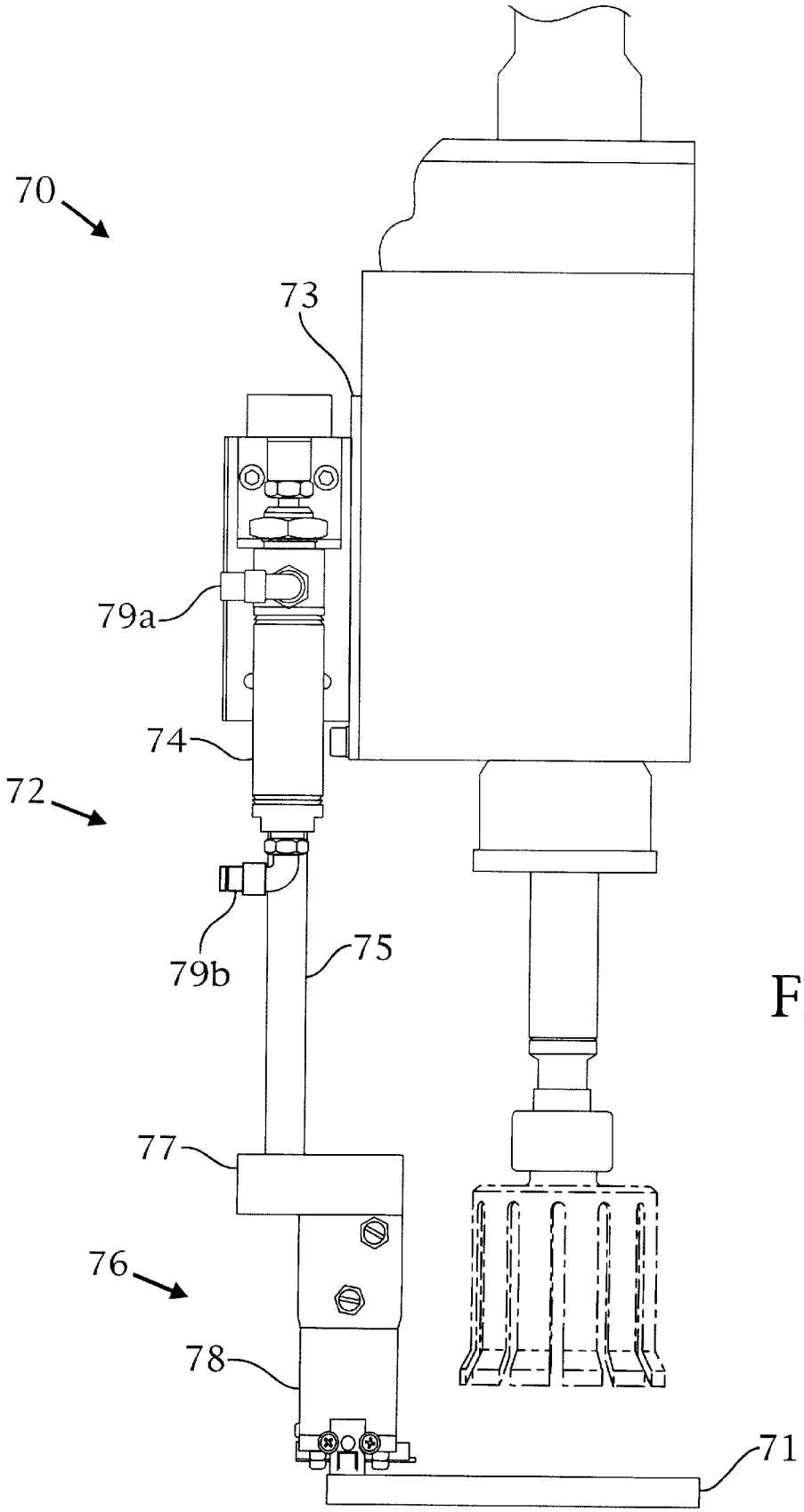
FIGS. 4, 5 and 6 are a side view, top view and rear view, respectively, of an alignment mechanism 70 that ensures that caps are correctly applied to containers.
Figure 5:
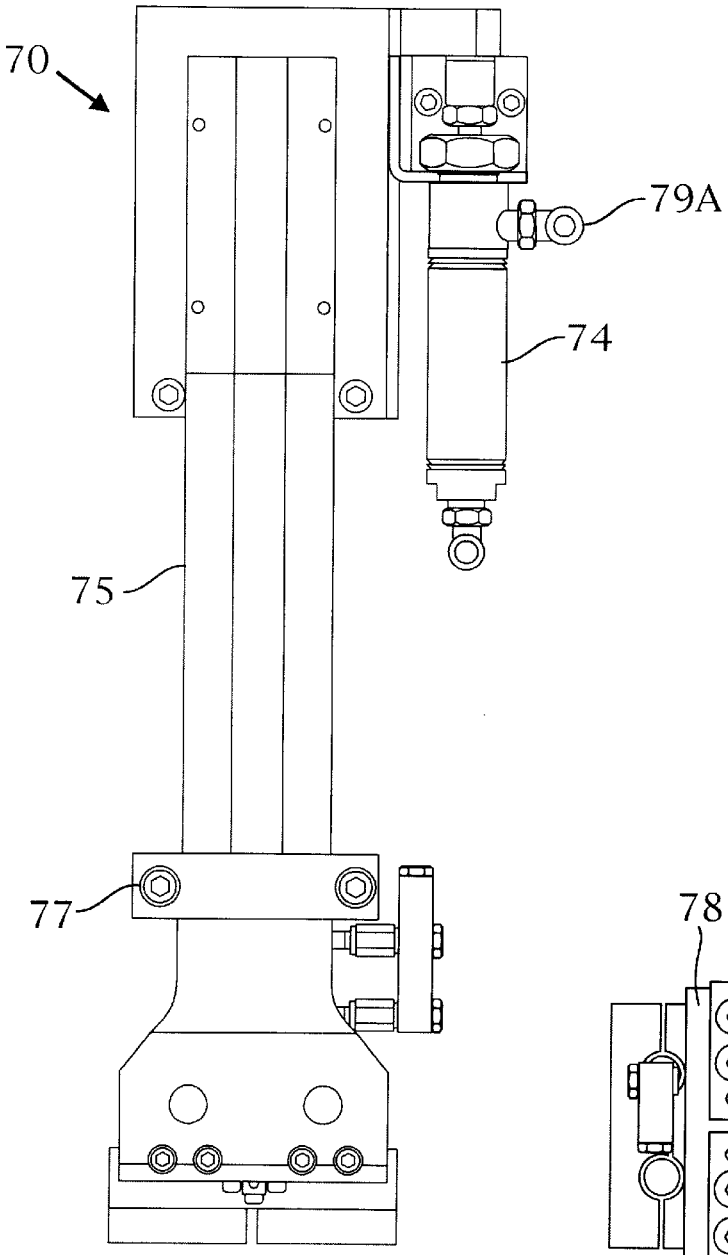
Figure 6:
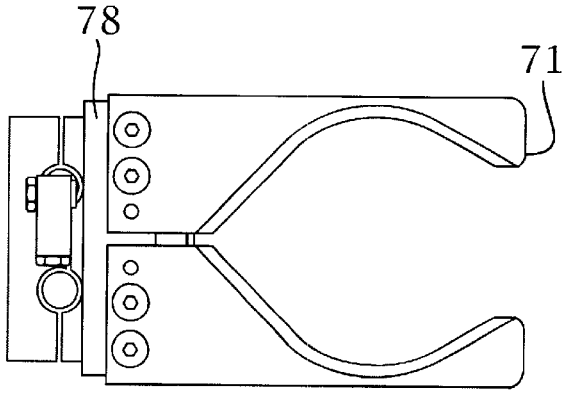

FIGS. 4, 5 and 6 are a side view, rear view and top view, respectively, of an alignment mechanism 70 that ensures that caps are correctly applied to containers. The alignment mechanism 70 is attached to the rear housing of each capping spindle (shown in dotted lines) and extends a pair of locator jaws 71 beneath the spindle to grab the neck of each container 19 just long enough to allow the threads of the cap to start to engage the threads on the container 19. Once the threads are fully engaged, the locator jaws 71 open to provide sufficient clearance to allow the cap to be completely applied to the container 19. This operation locates the containers 19 correctly for the capping chucks and acts as a gripping mechanism to stabilize the containers 19 during capping. With collective reference to FIGS. 4, 5 and 6, alignment mechanism 70 generally includes the pair of pneumatic-controlled locator jaws 71 suspended from the spindle by an articulating actuator assembly 72. Actuator assembly 72 is mounted to the spindle housing by a plate 73, and this secures a pneumatic cylinder 74 directly behind the spindle. The pneumatic cylinder 74 is a commercially-available part from, for example, Bimba, Inc. A downwardly extending piston 75 is mounted in the pneumatic cylinder 74, and a jaw actuator assembly 76 secures the locator jaws 71 to the distal end of the piston 75 directly beneath the capping chuck (dotted lines). The jaw actuator assembly 76 comprises a clamping block 77 for screw attachment to the downwardly extending piston 75, and a gripper 78 secured to the clamping block for extending the locator jaws 71 outward toward the capping chuck. The gripper 78 is a commercially-available part from, for example, Robohand, Inc. The locator jaws 71 are formed as shown to provide a uniform griping force around the necks of the containers 19, and the exact contour of the jaws will vary accordingly. The pneumatic cylinder 74 includes separate pneumatic inputs 79*a* & 79*b* to control extension and retraction of piston 75, and thus the locator jaws 71 can attain any combination of "up" and "open" or "down" and "closed".

Figure 7:
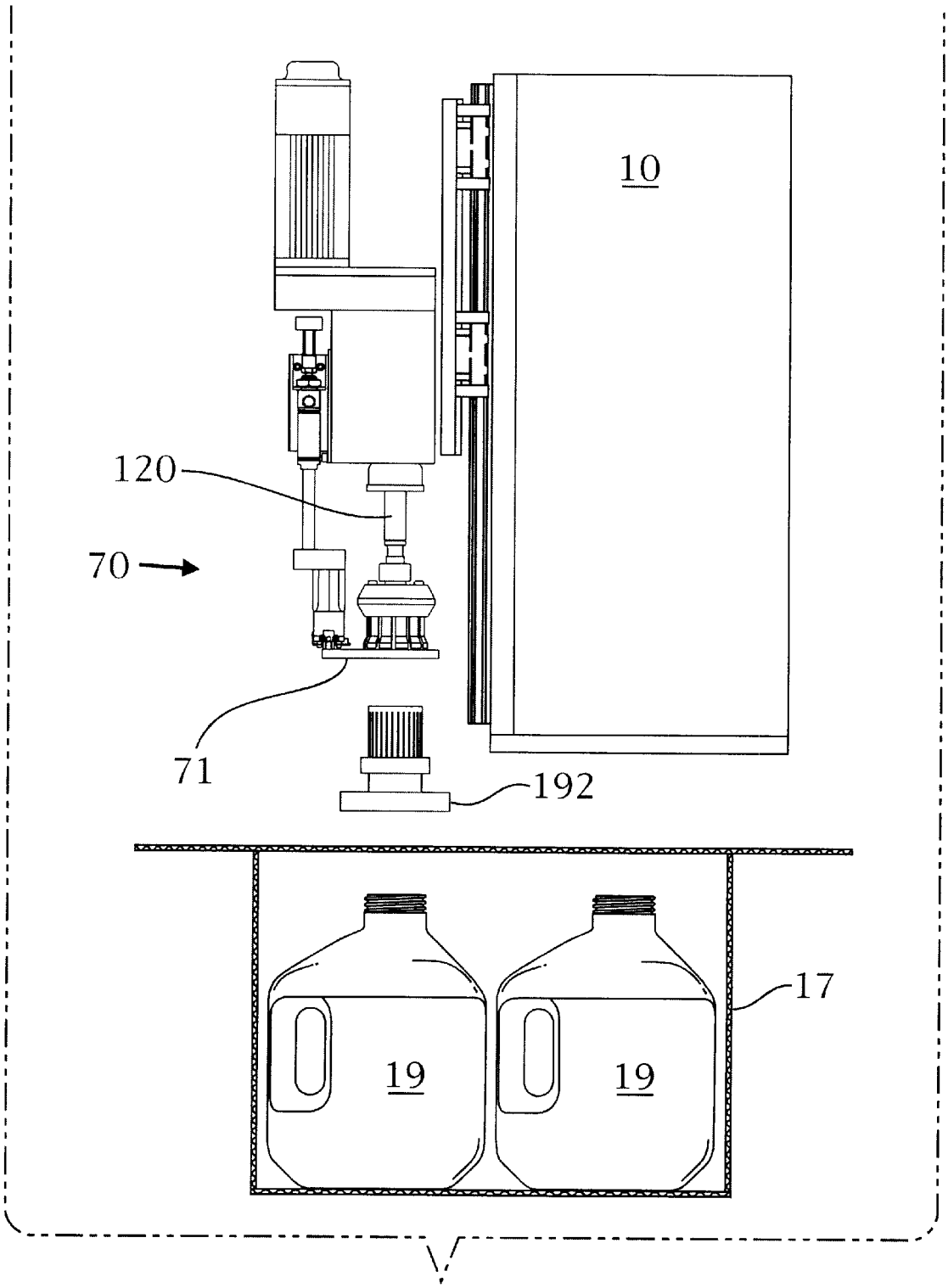
FIGS. 7–14 are sequential drawings illustrating the cap application process of one of the two identical cappers in assembly 10.

The operation of the articulating actuator assembly 72 of FIGS. 4–6 will now be described with reference to FIGS. 7–14, which are sequential drawings illustrating the cap application process of one of the two identical cappers in assembly 10. The caps 192 are put onto the containers 19 sequentially, two-by-two, row-by-row, container by container, by the capping chucks of each of the two Capamatic™ multi-spindle capping machines. Thus, the two cappers in assembly 10 work in tandem As shown in FIG. 7, the capping cycle begins with the capping mechanism's spindle assembly 120 and the locator jaws 71 of an alignment mechanism 70 in the "up" and "open" position.

Figure 8:
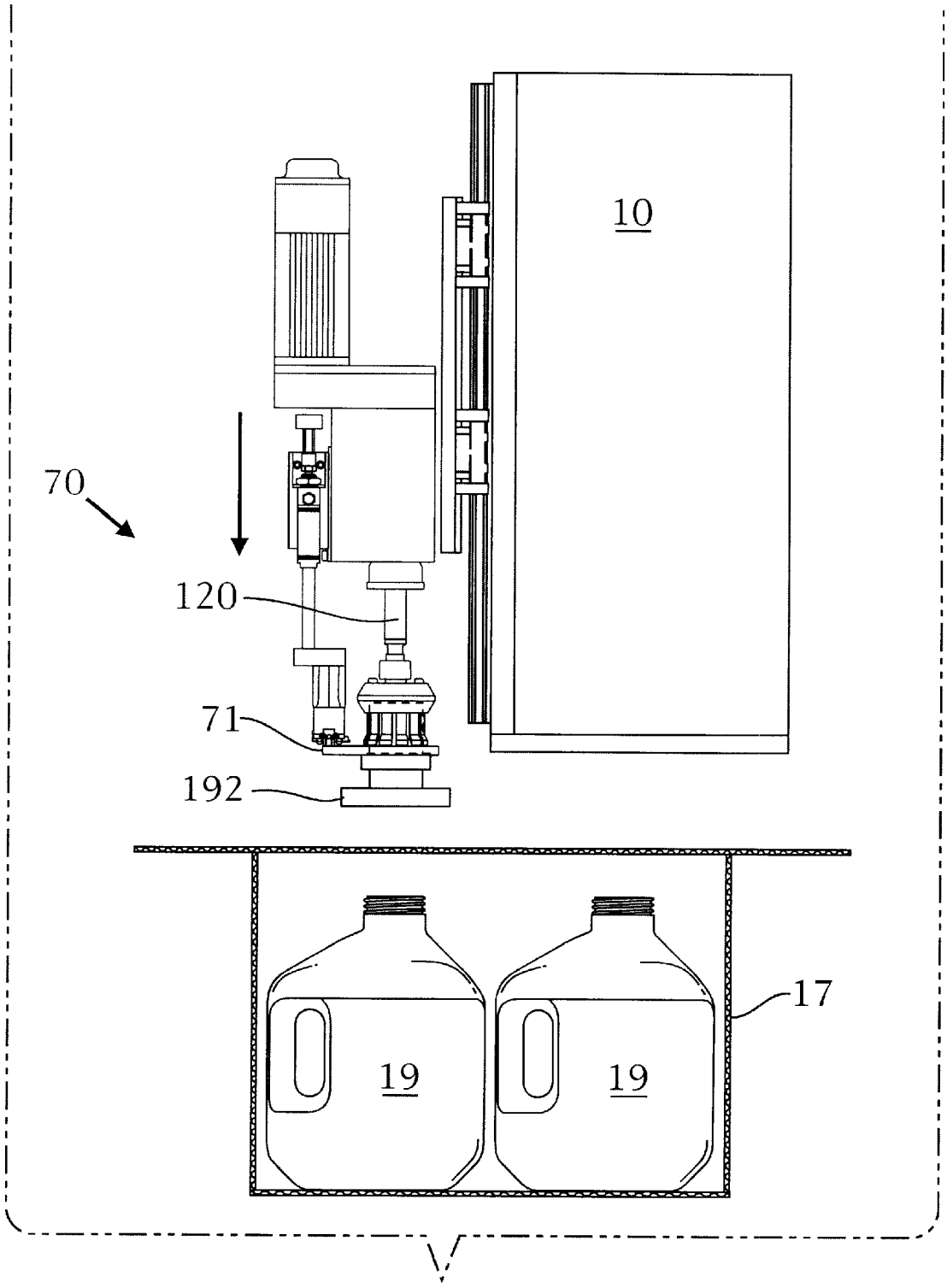

As seen in FIG. 8, under servo control the spindle assembly 120 descends to pick up the cap from the splitter plate 192. After grasping the cap 195, the spindle assembly rises slightly allowing the splitter plate 192 to retract, passing just below the bottom edge of cap 195. Once the splitter plate 192 has retracted, the alignment mechanism 70 and spindle assembly 120 descend to the "down" position.

Figure 9:
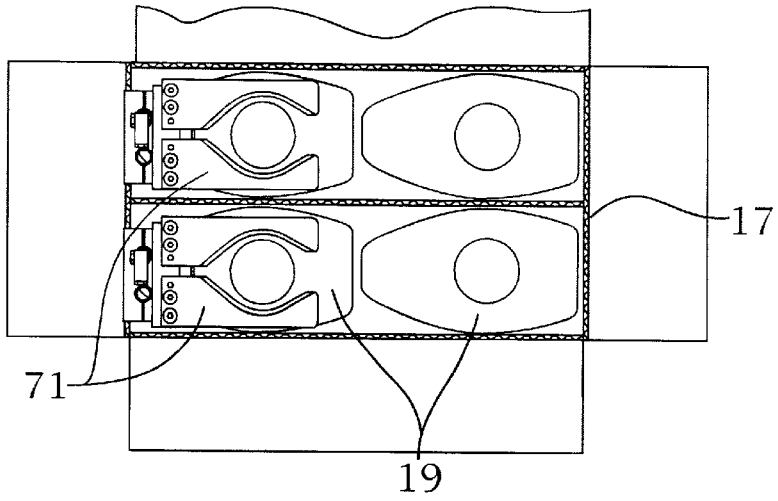
Figure 10:
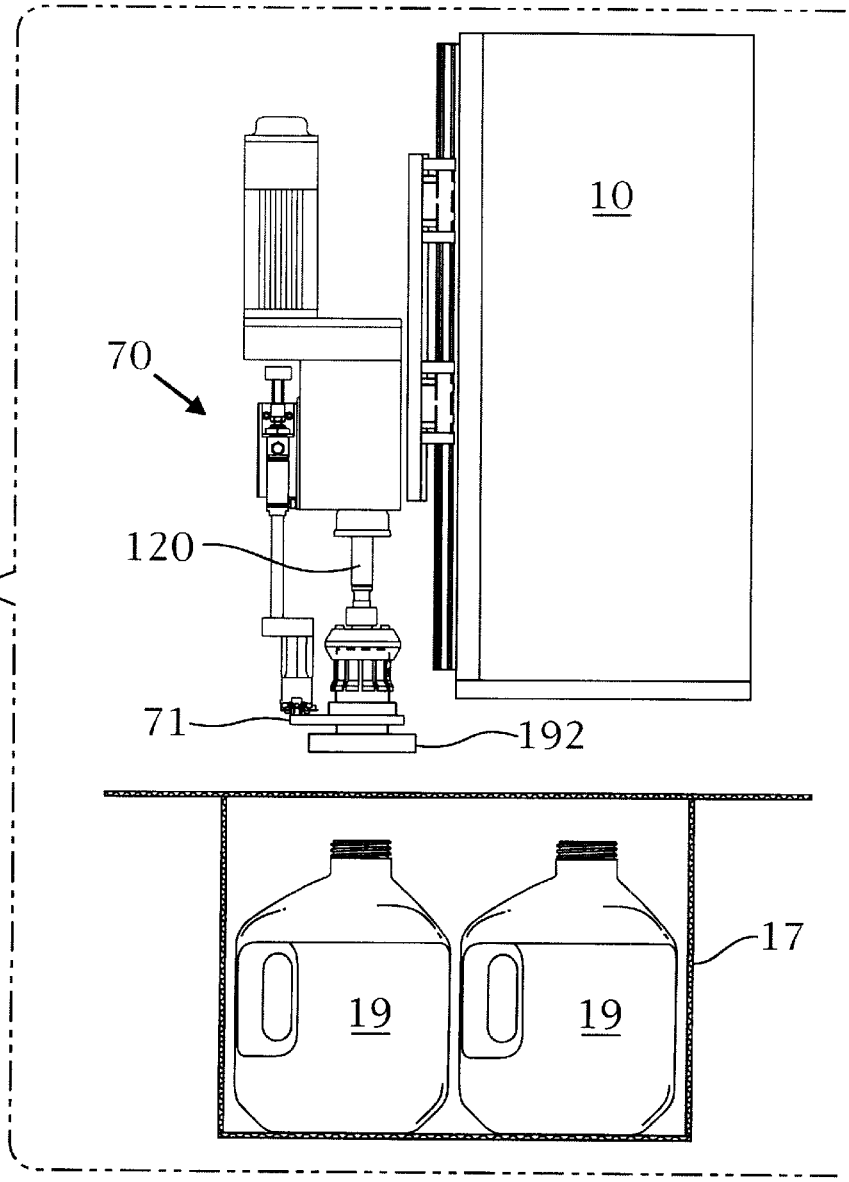

As shown in FIGS. 9 and 10, the entire capping mechanism moves horizontally to match the capping area indexing assemblies 13A and 13B movement of the case and its filled containers 19. While the capping chuck is in motion directly above the moving case 17 and filled containers 19, the alignment mechanism 70 descends to the "down" position.

Figure 11:
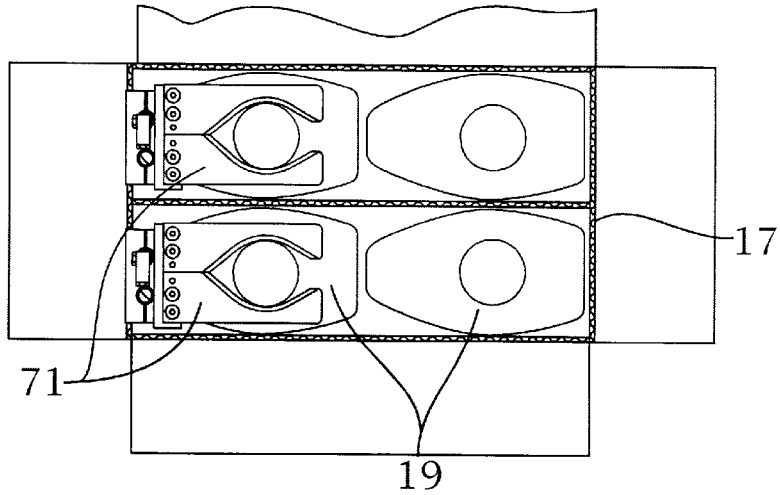
Figure 12:
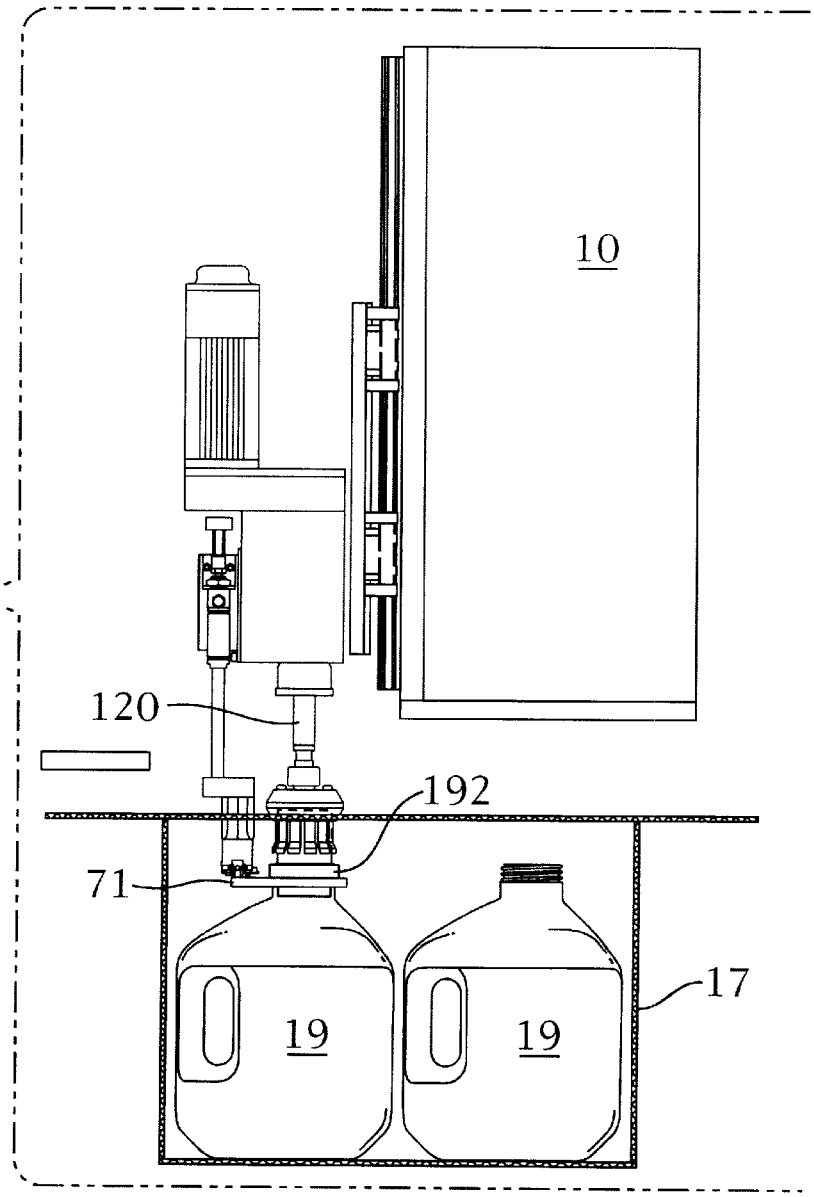

As shown in FIGS. 11 and 12, once the alignment mechanism 70 reaches the "down" position, the locator jaws 71 move to the "closed" position around the neck of the container 19. After the neck of the container 19 has been grasped by the locator jaws 71, and the case and its containers 19 are positioned beneath the capping chucks by indexing assemblies 13A and 13B, the capping chucks descend to apply the caps 192 to the container 19 neck openings.

Figure 13:
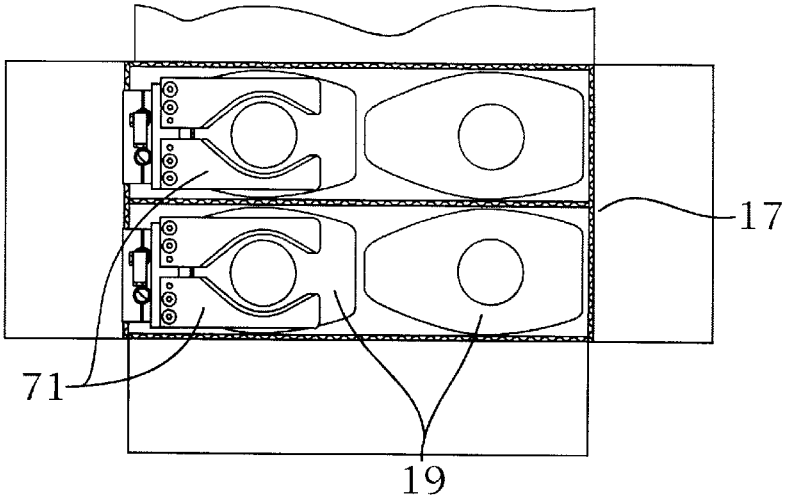
Figure 14:
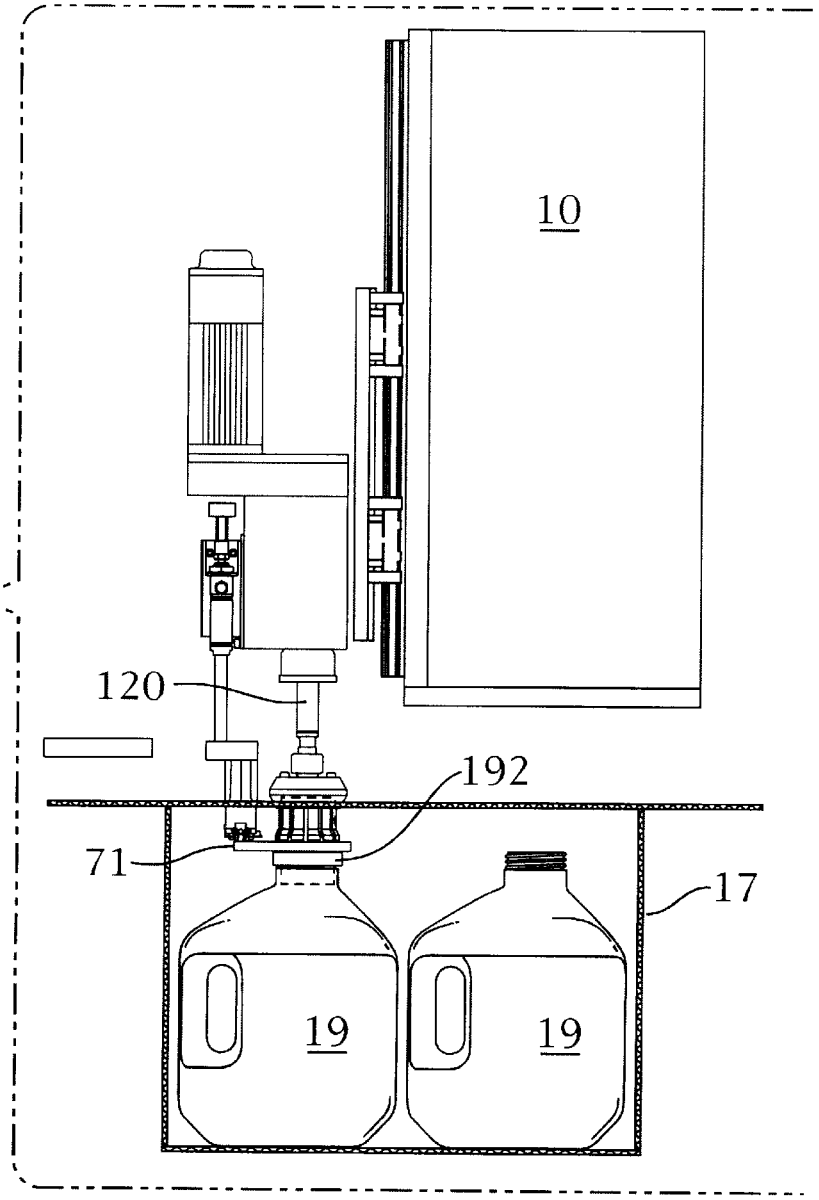

As shown in FIGS. 13 and 14, as the threads on the cap 192 begin to engage the threads on the neck of the container 19, the locator jaws 71 return to the "open" position. This must occur in order to provide the spindle assembly and the cap with complete access to the neck of the container 19. Once the cap application process is complete and the cap has achieved the required application torque, the capping mechanism, spindle assembly, and alignment assembly 70 return to the start position.

After the caps have been put on the first two containers, the cases 17 in lanes 1A and 1B are indexed to the forward position to cap the second set of two containers. Thus, the chucks move across the first row of containers, across the second row, on to the next case, and so on. After the capping operation is completed, the case is released to travel to the combining area.

As the caps are being put on the containers, inspections for missing and cocked caps are made. The capping chucks are driven by a servo torquing mechanism, and a certain number of revolutions are required to install the cap correctly. If too few revolutions are performed, the cap is cocked. If too many revolutions are performed, then there is no cap in the chuck. Thus, this inspection process does not require sensors or a vision system. It is a function of the positional feedback capability of the Capamatic™ multi-spindle capping machines of capper assembly 10 (the servo motors used therein employ closed loop technology) and the programming of its control system. If, during a typical capping cycle, the number of revolutions of the capping chuck does not correspond with that contained in the control program (known to be the appropriate number to achieve successful application of the cap), something is wrong and the feedback is analyzed.

Preferably, the in-process quality control system is also configured to verify the capping machine application torque. During a test cycle, a cap is allowed to relax for approximately five seconds before it is carefully removed by the servo-chuck and the removal torque determined and reported. The caps will then be replaced and the finished case sent to a combining area. Any readout that is out of specification will be reported by the PLC 23. The in-process quality control check occupies thirty to sixty seconds depending upon the number of containers in a case.

After the containers are filled, capped and inspected, they proceed to a combining area where a case converging system 14, commercially available from Roach Manufacturing Corporation, recombines the cases from the separate lanes into a single lane. From there, the cases are typically sent onward to a case sealer (not shown). Case converging system 14 controls the convergence of the cases into a single conveyor lane after the filling and capping processes have been completed.

Figure 15:
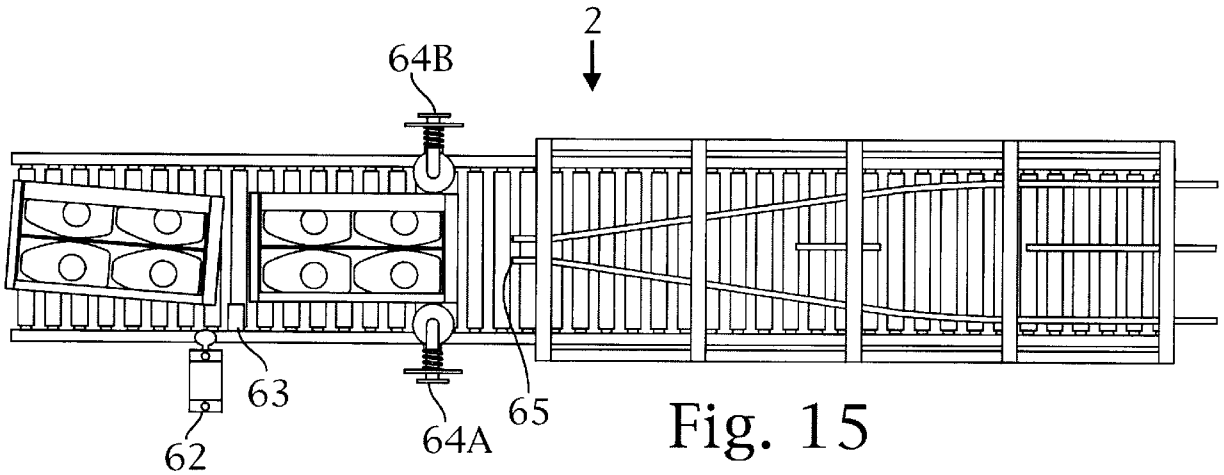
FIGS. 15 and 16 are a top perspective view and a side view, respectively, of a flap opening system 2 as used in the two-lane, multi-function in-case filling and capping apparatus described above.
Figure 16:
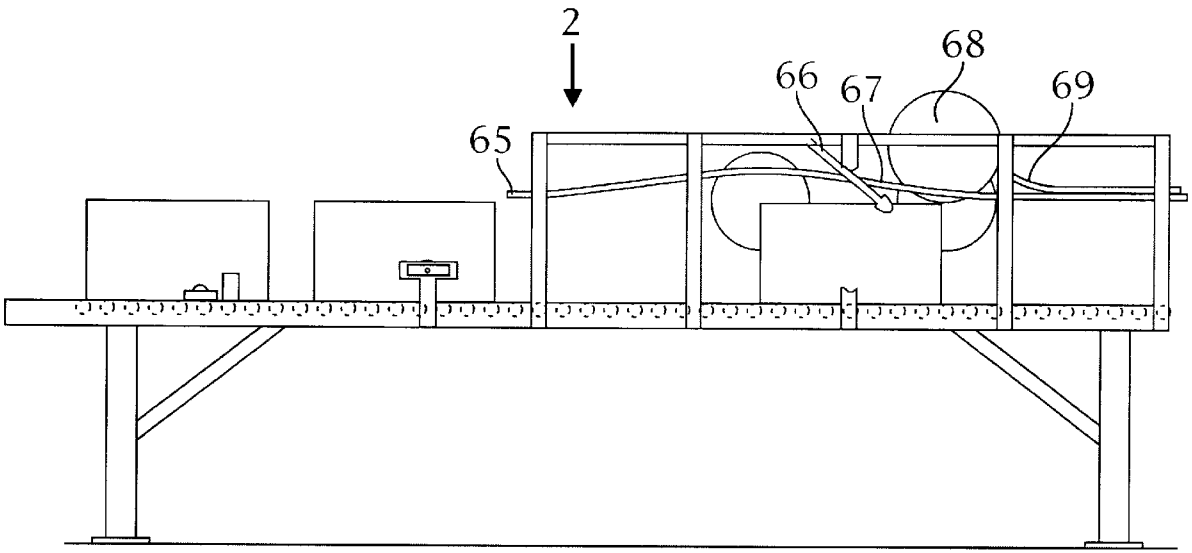

FIGS. 15 and 16 are a top perspective view and a side view, respectively, of a flap opening system 2, commercially available from Bay Design, Inc. of Baltimore, Md., as used in the two-lane, multi-function in-case filling and capping apparatus described above. The flap opening system comprises two powered rollers side belt assemblies 64A and 64B, a major flap opener plow assembly 65, a servo-driven pivoting arm assembly, and a hook mechanism 66. The cases are received with the major flaps partially opened from the upstream conveyor loading process. Each case travels along the system conveyor 15 until it is pulled into the flap opening system 2 by powered side belts 64A and 64B. The partially opened major flaps of the case are fully opened by the plow assembly 65. The leading, minor flap of the case is pulled open by the pivoting arm assembly while the hook mechanism lifts the trailing, minor flap. Once all of the case flaps have been opened, the case enters the flap control rails 69. Flap control rails 69 extend through the filling and capping functions before ending at a point just downstream from the capping area, and prevent the case flaps from closing.

Figure 17:
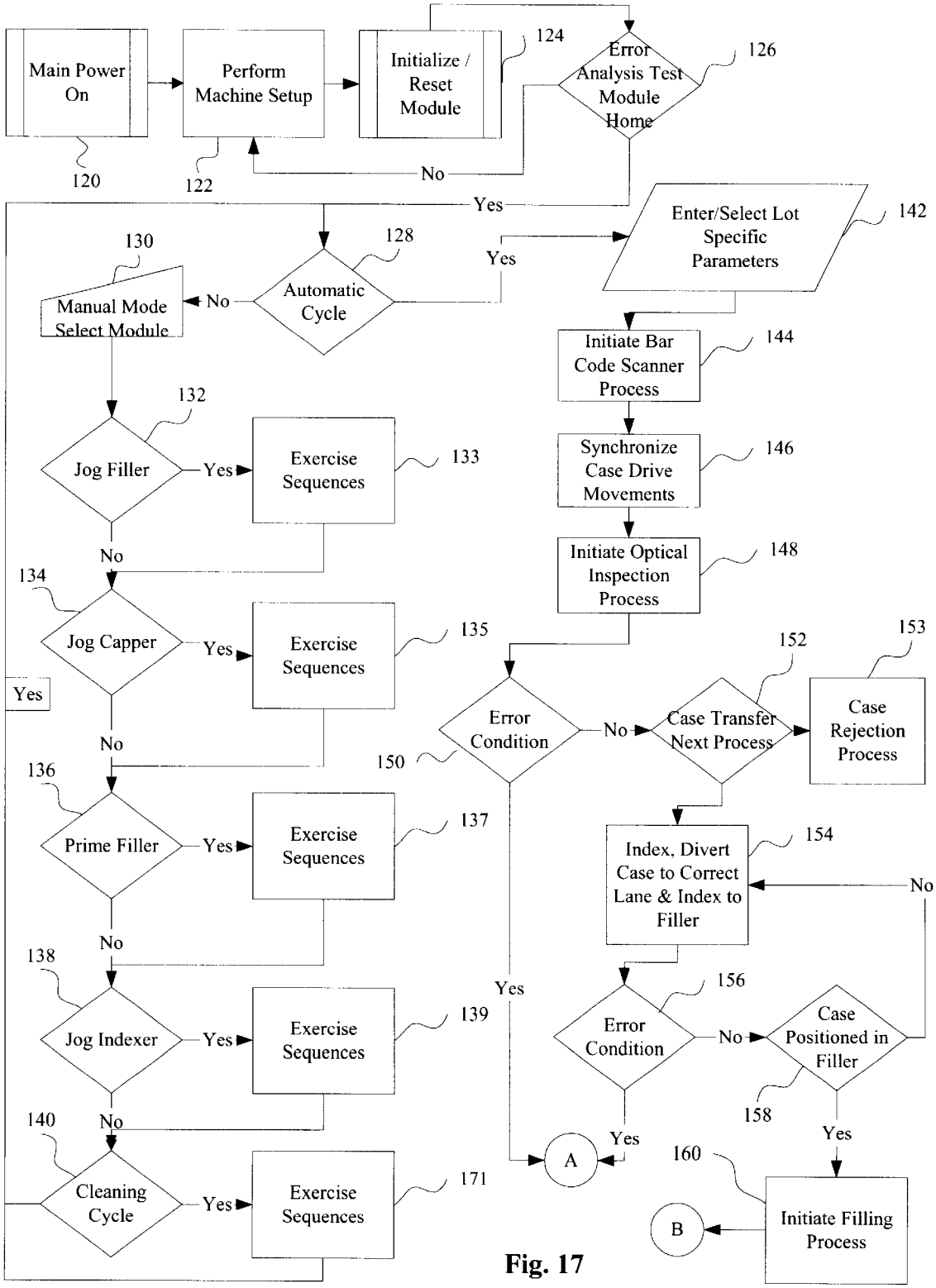
FIGS. 17 through 19 collectively comprise a flow chart illustrating the sequence of operation of the embodiment of FIG. 2 as administered by the programmable logic controller ("PLC") to all connected components.
Figure 18:
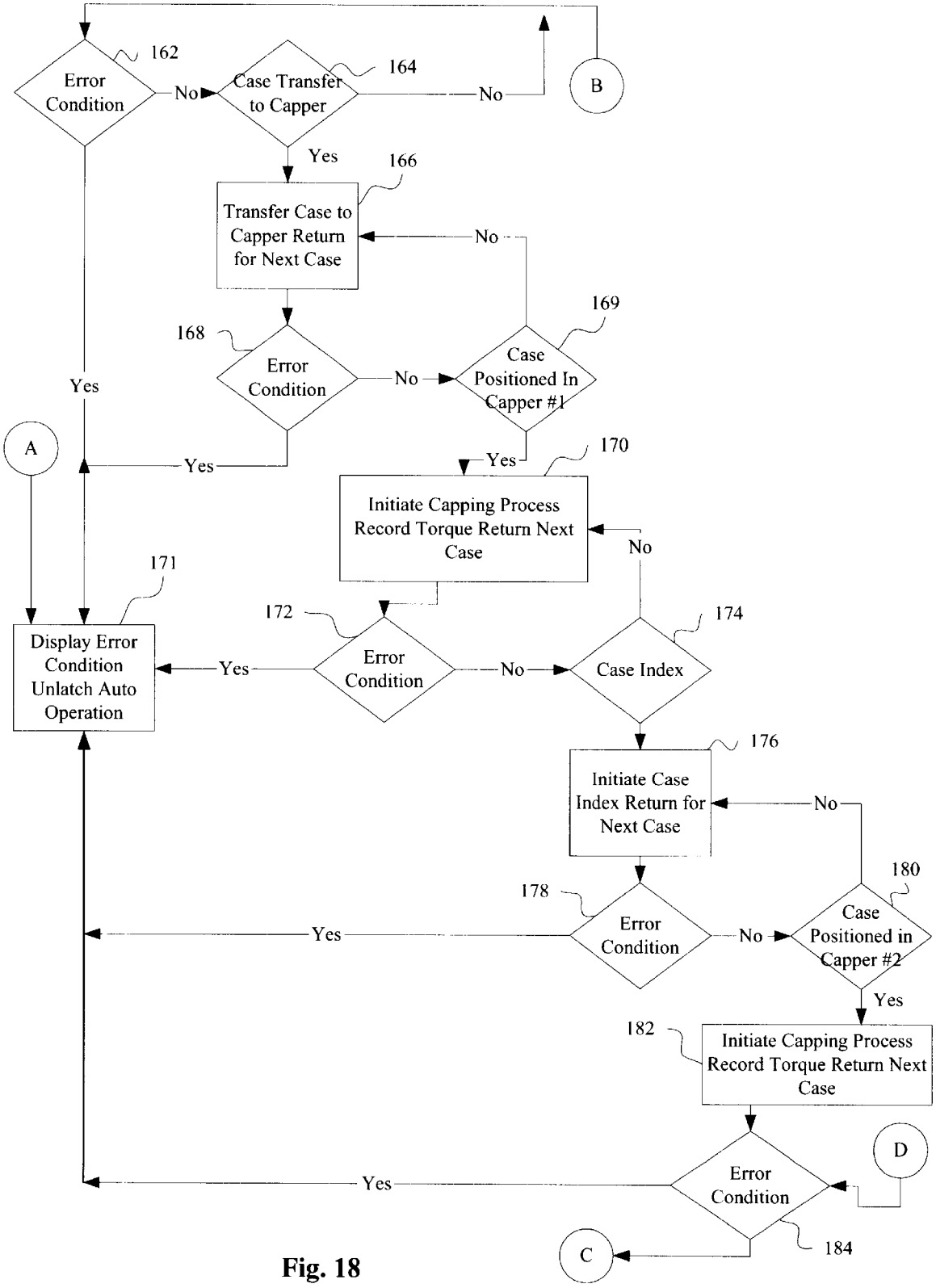
Figure 19:
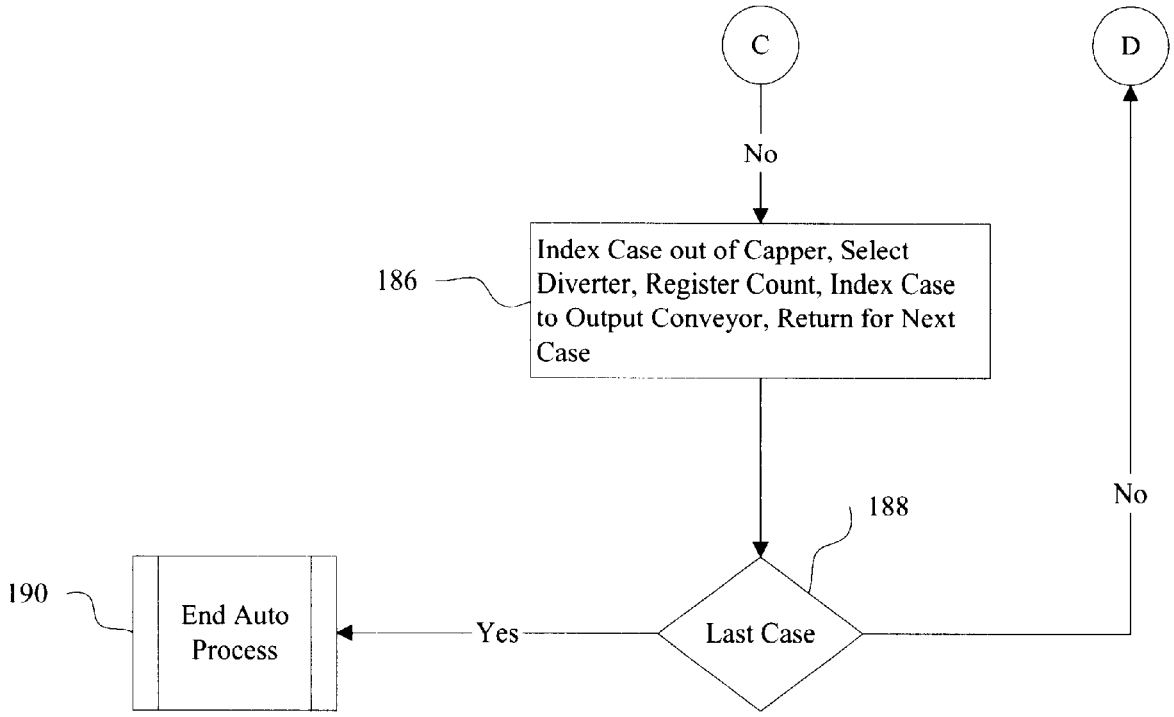

FIGS. 17 through 19 collectively comprise a flow chart illustrating the sequence of operation of the embodiment of FIG. 2 as administered by the PLC 23 to all connected components.

At step 120 the main power is turned on.

At step 122 the operator performs machine setup for the cases and containers to be filled and capped.

At step 124 the PLC resets all connected components.

At step 126, the PLC performs a self-test on all connected modules and returns to step 122 if a component fails to pass.

If all components pass the self-test, the PLC asks the operator if he wishes to enter the automatic cycle at step 128. If the user indicates no, then the PLC initiates manual mode at step 130. In manual mode, the user is prompted to initiate each control sequence one-by-one.

If the user initiates the jog filler at step 132, the filling exercise sequence is carried out at step 133 and program flow proceeds to the next operation.

If the user initiates the jog capper at step 134, the capping exercise sequence is carried out at step 135 and program flow proceeds to the next operation.

If the user initiates the prime filler at step 136, the prime filling exercise sequence is carried out at step 137 and program flow proceeds to the next operation.

If the user initiates the jog indexer at step 138, the indexing is carried out at step 139 and program flow proceeds to the next operation.

Finally, if the user initiates the cleaning cycle at step 140, the cleaning cycle is carried out at step 141 and program flow returns for another job to step 128.

Alternatively, if at step 128 the user instead selects automatic cycle, program flow proceeds accordingly to step 142 where the user is prompted to enter all necessary job, case, container and cap parameters.

At step 144, the bar code scanner process is initiated. The bar code reader 20 of FIG. 2 outputs the bar-coded information to the PLC to verify that each case entering the filling and capping areas matches the setup parameters of the equipment, such as fill volume and cap torque.

Next, the case is indexed at step 146 into the optical inspection station 3, and the optical inspection process is initiated at step 148. Here the vision system of optical inspection station 3 determines whether any containers are missing from the case, and whether any containers are not properly oriented. Cases that fail the optical inspection station 3 at step 150 are rejected and are urged off the system conveyor 15 by automatic pusher bar assembly 4, and accumulated on case collection roller conveyor 5.

If the case passes at the optical inspection station 3 at step 150, the case is transferred down conveyor 15 for the next process (see step 152). At step 152, the case is transferred to the case directing system 6.

The cases are properly indexed by the first indexing assemblies 9A and 9B at step 154, and each indexed case enters case directing system 6 and is allowed to either proceed along the main conveyor lane IA or is diverted onto the secondary conveyor lane 1B depending on backlog.

At step 156 error conditions are flagged and displayed to the operator at step 171

The first case indexing assemblies 9A and 9B position the respective cases for filling at step 158. The PLC then initiates the filling process at step 160, and the filling assemblies 72A and 72B fill the containers.

Assuming that the containers are properly filled at step 162, the PLC directs the cases to be transferred to the capper 10 at step 164, and this is accomplished at step 166.

At step 168, the cases are indexed onto the respective capping servo conveyors. If the cases are properly positioned at step 162, each capper indexing assembly 13A and 13B positions the first row of containers in its case for capping at step 168. The PLC then initiates the capping process at step 170, and the capper 10 caps its containers from bowls 12A and 12B at step 170. Upon completion, the caps are checked for errors at step 172 and, if no errors are present at step 178, another case is retrieved by each indexing assembly 13A and 13B for capping at step 176. Each indexing assembly 13A and 13B positions the second row of containers in its case for capping at step 180. The PLC 23 then initiates the capping process at step 182, and the capping apparatus 10 caps its containers from bowls 12A and 12B at step 182. Upon completion, the caps are checked for errors at step 184 and, if no errors are present at step 186, the cases are indexed out of the capper 10, they are counted, and they are indexed out to case converging system 14 which recombines the cases from the separate lanes into the single lane on the output conveyor. The capper indexing assemblies 13A and 13B then initiate processing of the next cases. Once the last case has been processed at step 188, the job ends at step 190.

The dual lane capping and filling process greatly improves efficiency and throughput.

Figure 20:
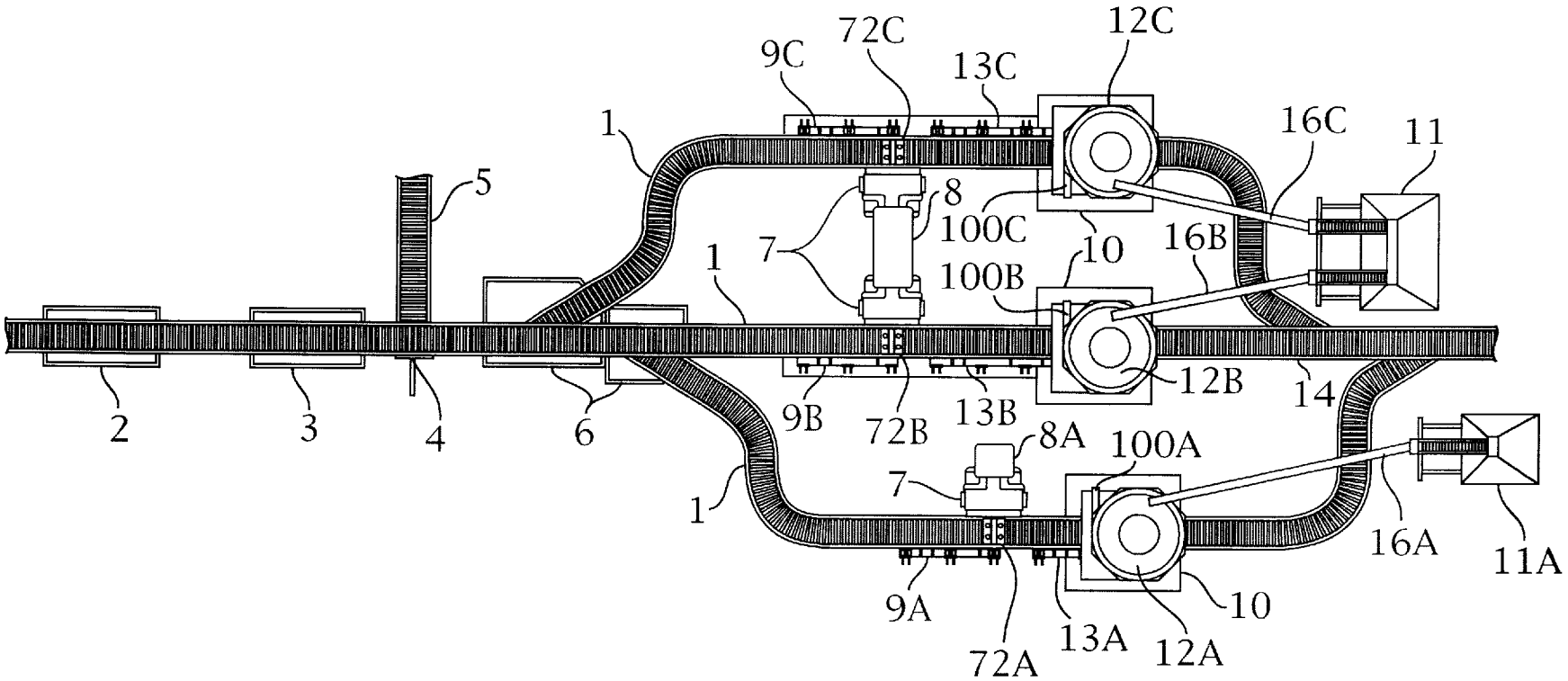
FIG. 20 is a top perspective view of a three-lane, multi-function in-case filling and capping apparatus according to a second embodiment of the present invention.

FIG. 20 is a top perspective view of a three-lane, multi-function in-case filling and capping apparatus according to a second embodiment of the present invention. The three-lane, multi-function in-case filling and capping apparatus of FIG. 20 is intended to illustrate the ease by which the basic configuration of the present invention can be expanded to any number of parallel lines.

Figure 21:
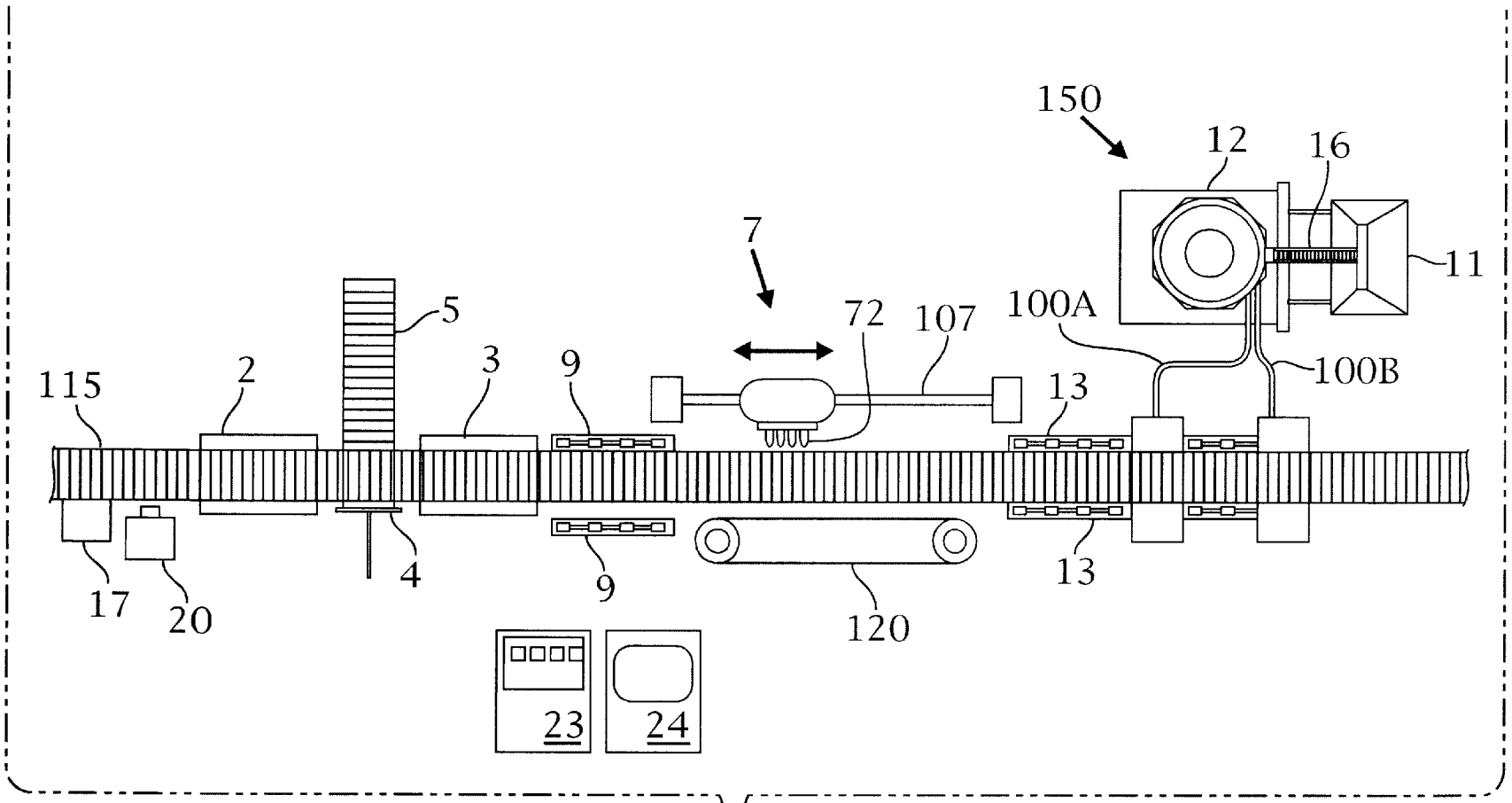
FIG. 21 is a top perspective view of a single-lane, multi-function in-case filling and capping apparatus incorporating continuous tandem filling and capping stations to improve the station-to-station transfer efficiency according to another embodiment of the present invention.
Figure 22:
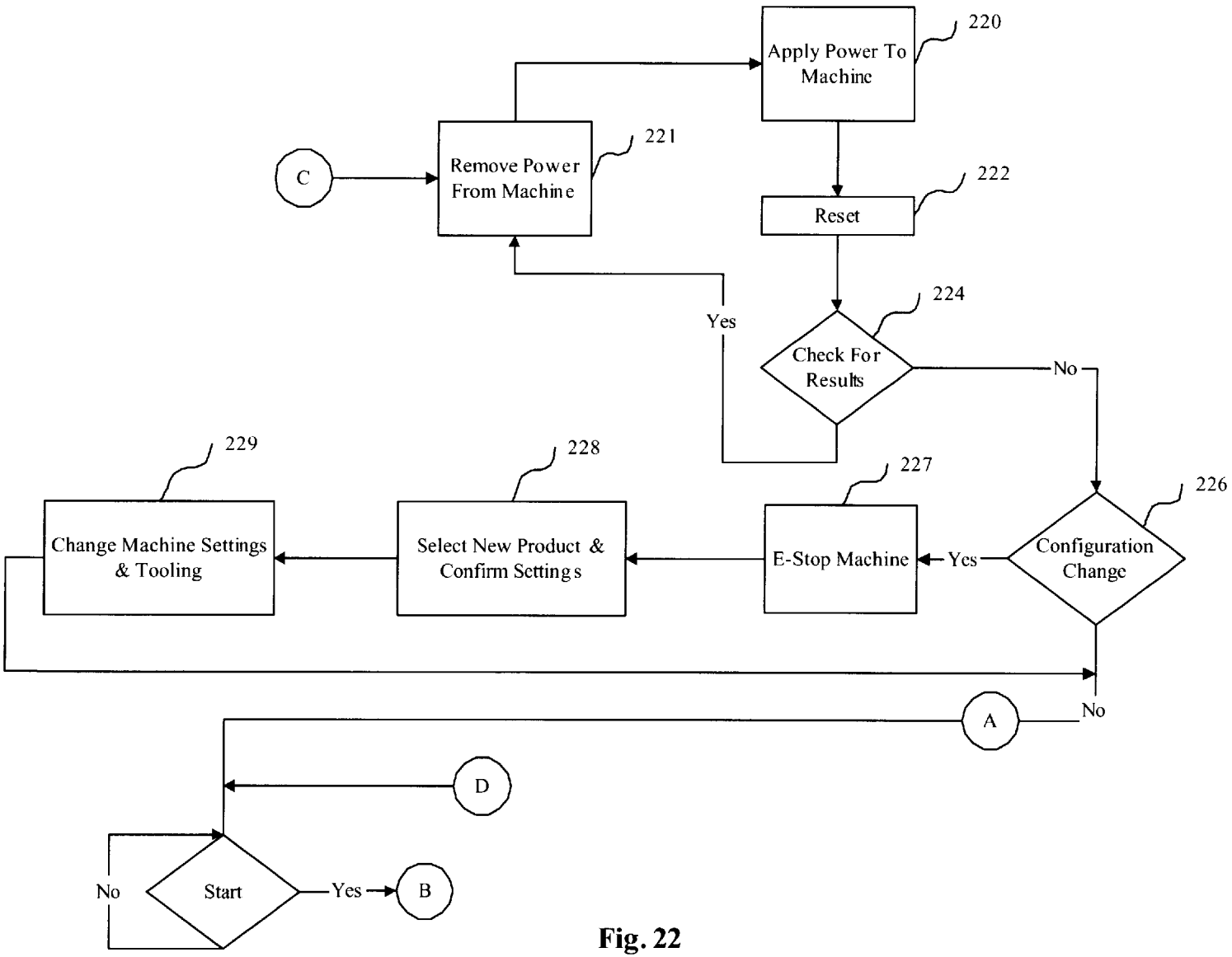
FIGS. 22 through 27 collectively comprise a flow chart illustrating the sequence of operation of the embodiment of FIG. 21 as administered by the PLC to all connected components.
Figure 23:
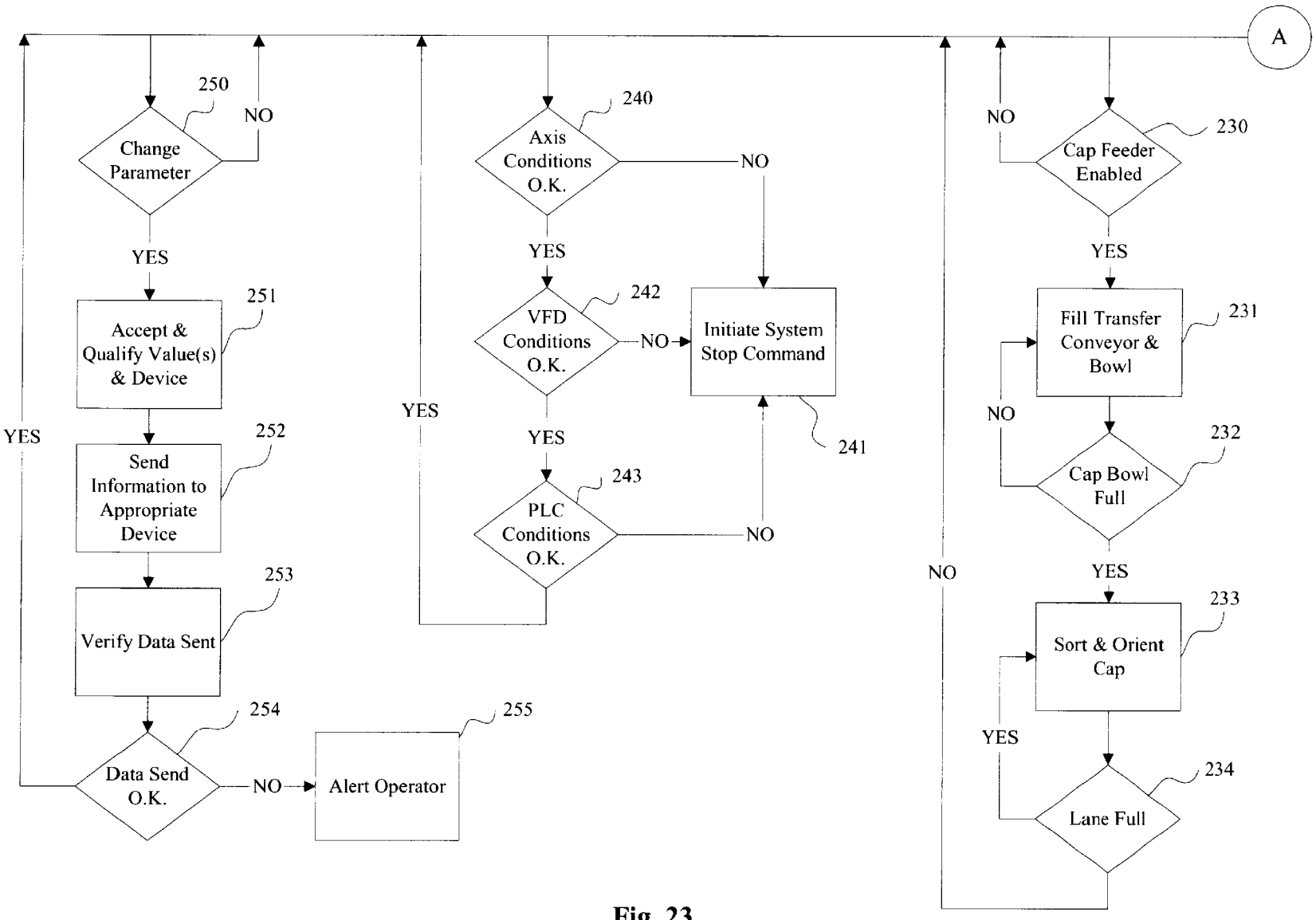

FIG. 21 is a top perspective view of a single-lane, multi-function in-case filling and capping apparatus incorporating continuous-motion filling and capping stations to improve the station-to-station transfer efficiency according to another embodiment of the present invention. As before, the device is designed for automated high-volume filling and capping of containers 19 in cardboard cases 17 such as described previously, and other like components will herein be described with reference to like numbers.

The cases 17 containing the empty containers 19 are placed at the start of a single-line system conveyor 115 from the loading dock. Each empty case enters the system from the left and is conveyed through the system (from left to right) via the system conveyor 115. As before, system conveyor 115 is a conventional track and roller-type conveyor as commercially available from, for example, MHS or AMBEC, Inc.

Likewise, the cases 17 are conveyed past a conventional bar code reader 20 which scans the bar code 15 (as described above).

After passing the bar code reader 20, the case 17 proceeds along conveyor 1 15 to a flap opener 2. As before, the flap opener 2 automatically opens all four flaps of the case.

Once the flaps have been opened, the case 17 proceeds along conveyor 115 to an optical inspection station 3 (as described above). The case is inspected to make sure that the containers are present and properly oriented. Optical inspection station 3 again incorporates means for centering cases 17 during inspection, and for ejecting any non-conforming cases via a pusher bar assembly 4 which moves the non-conforming cases onto a rejected case collection conveyor 5. Each open case is indexed into optical inspection station 3 where the vision system at inspection station 3 determines whether any containers are missing from the case, and whether any containers are not properly oriented within the case. Cases that fail at the optical inspection station 3 are rejected and are urged off the system conveyor 115 by automatic pusher bar assembly 4, and are accumulated on case collection roller conveyor 5.

The open cases are then fed into the filling and capping area, where they proceed to a case indexing assembly 9. Case indexing assembly 9 comprises a continuous cleated servo-driven belt spanning the length of the filling and capping area, the cleats of which engage each case to move it along system conveyor 115. The case indexing assembly 9 transports each case (under PLC 23 control) into the proper filling position under the nozzles 72 of the filling apparatus 7. Though capable of positioning cases singly, case indexing assembly 9 preferably transports the cases into the proper filling position in tandem pairs. The open cases travel down conveyor 115 in a properly spaced configuration (spaced so as to avoid damage to the flaps).

Once the cases enter the filling area, the containers 19 can be located in proper alignment below the nozzles 72, while a bar pushes on the outside surface of the case to drive it against a fixed stop positioned on the side of the conveyor that is closest to the frame of the filling machine 7. Thus, the containers are maintained in proper alignment directly below their respective filling nozzles 72.

The filling apparatus 107 of the present embodiment includes a grouping of eight standard nozzles 72. However, in this embodiment, nozzles 72 are mounted on a servo-controlled walking-beam that extends the entire length of the filling area. This allows the servo-controlled walking-beam filling apparatus 107 to move nozzles 72. Thus, the nozzles 72 may be horizontally positioned in accordance with a conventional servo as available from, e.g., Kollmorgen, Inc. Moreover, the servo-controlled walking-beam filling apparatus 107 is connected to the PLC 23. This way, the travel of the servo-controlled walking-beam filling apparatus 107 can be synchronized to the travel of cases as transported by indexing assembly 9.

Following proper positioning of the lead case and containers under the filling nozzles 72 on conveyor 115 (with a tandem case immediately behind), the nozzles are lowered into the openings of the containers in both cases. However, both cases of containers continue to be carried by indexing assembly 9 along conveyor 115. The nozzles 72 of the walking-beam filling apparatus 107 track each pair of cases of containers along conveyor 115 as the air-operated valves in the tips of the nozzles 72 open and the correct volume of liquid is dispensed.

As before, servo-driven rotary lobe volumetric filling pumps are used to dispense the liquid into the containers, and suitable pumps are commercially available from Waukesha Fluid Handling under its rotary piston pump line. After the containers 19 are properly filled, the nozzles 72 close and the vacuum suck-off system located in the tip of the nozzle controls any drips. The nozzles are then lifted out of the containers in both cases simultaneously.

As soon as the containers in the first pair of cases are filled, the servo-controlled walking-beam filling apparatus 107 repositions the nozzles 72 over the next pair of cases and the containers therein.

As before, an in-process quality control system is preferably incorporated to automatically determine inappropriate fill volumes which may then be adjusted automatically or by a system operator. For this purpose, a check-weight scale is located in the filling station, which on a timed demand (at intervals determined by the customer), will rise up under an empty case to tare-weigh the case. If any of the fill volumes are out of control limits but within specifications because of a temperature change, a viscosity change or a change in specific gravity, the pump will automatically be re-calibrated by the PLC 23. A servo is used to register the correct number of counts corresponding to the correct fill volume. Any pump errors exceeding specifications are flagged and the operator is notified. When this in-process quality control system is in operation, the case remains stationary on the scale (the continuous-motion filling process is temporarily suspended).

The coordination between the servo-controlled walking-beam filling apparatus 107 and indexing assembly 9 essentially allows both cases (of four containers each) to be filled in the same amount of time as one stationary case of containers. This greatly improves the efficiency of the filling operation. Of course, the servo-controlled walking-beam filling apparatus 107 can easily be adapted for larger or smaller numbers and groupings of nozzles 72 to accommodate larger/smaller cases and greater or fewer containers.

After the filling operation is complete, the filled case is carried by the indexing assembly 9 onward to the capping area.

Once the case enters the capping area, case indexing assembly 9 transports the cases into the proper position under the continuous-motion capping apparatus 150. Thus, the containers are maintained in proper alignment throughout the continuous-motion capping process. While the case indexing assembly 9 is capable of transporting cases singly, in this embodiment two cases are preferably transported in tandem to improve throughput.

Each of the two cappers in assembly 150 is a Capamatic™ multi-spindle continuous-motion capping machine, commercially available from NIC, preferably having two spindles/capping chucks. In this embodiment caps are fed out of a common central prefeeder assembly 11. In exactly the same manner as the embodiment of FIG. 2, chutes deliver the caps to respective splitter plates each comprising a shallow guide plate with forked grooves for dividing caps between two transfer stations, and the capping chucks at each of the two cappers pick up the caps from the respective transfer stations. A like alignment mechanism 70 ensures that caps are correctly applied to containers by each spindle/capping chuck. This operation locates the containers 19 correctly for the tandem capping chucks and acts as a gripping mechanism to stabilize the containers 19 during capping. As before, the combination of pre-feeder assembly 11, chute 16, and rotary feed bowl 12 is commercially available from Farason Corp.

The capping chucks pick up caps from the splitter plates associated with tracks 100A and 100B. After grasping the caps, the capping chucks rise slightly such that the bottom edges of the caps just clear the splitter plates. The capping chucks then begin moving horizontally to follow the movement of the cases as the chucks descend to their respective containers. As before, the containers are locked into position by the jaws 71 of alignment mechanism 70, thereby locating the containers correctly for the capping chucks and acting as a gripping mechanism for the containers as well.

The caps are put onto the containers sequentially, four-by-four, by the two pairs of capping chucks of each of the two Capamatic™ multi-spindle continuous-motion capping machines of capper assembly 150. The leading pair of chucks tracks the forward row of containers in the leading case while the rearward pair of chucks simultaneously tracks trailing row of the second tandem case. After the caps have been put on the first two containers in both tandem cases, the tandem cases 17 are indexed to the forward position to cap the second set of two containers. Thus, the chucks also work in tandem applying caps to either the leading or trailing pair of containers in each case from one pair of cases to the next, and so on. After the capping operation is completed, the pair of cases is released to travel along conveyor 115 to the discharge area.

As before, as the caps are being put on the containers, inspections for missing and cocked caps are made using the existing servo torquing mechanism. A certain number of revolutions are required to install the cap correctly. If too few revolutions are performed, the cap is cocked. If too many revolutions are performed, then there is no cap in the chuck or the threads have been stripped.

After the containers are filled, capped and inspected, they proceed to the case sealer.

To coordinate and synchronize the operation of all active components, all of the following components are connected to the PLC: bar code reader 20, flap opener 2, optical inspection station 3, case indexing assembly 9, the servo-controlled walking-beam filling apparatus 107, in-process quality control system, and continuous-motion capper assembly 150. The interface with all components is again as shown in FIG. 3, thereby allowing the PLC to control the entire program flow.

FIGS. 22 through 27 collectively comprise a flow chart illustrating the sequence of operation of the embodiment of FIG. 21 as administered by the PLC to all connected components.

At step 220 the main power is turned on.

At step 222 the PLC resets all connected components.

At step 224, the PLC performs a self-test on all connected modules. Should any faults be detected, the operator powers down the system at step 221 and the process returns to step 220.

If all components pass the self-test, the PLC asks the operator if he wishes to change the existing system configuration (for a different container) at step 226. If the user indicates yes, the PLC cycles through a series of changeover steps including an emergency stop at step 227, menu selection of the new container settings and conformation thereof at step 228, and a manual changeover of any necessary tooling parts at step 229. Once the changeover is completed (or if the existing system configuration is not changed), then the PLC initiates a sequence of diagnostic steps shown at FIG. 23.

At step 230 the PLC initiates the prefeeder assembly 11 and ensures that the rotary feed bowl 12 is filled. If the bowl is not filled per check at step 232, step 231 is repeated as needed.

Once the bowl is full the prefeeder assembly 11 sorts and orients the caps (step 233) and ensures that the chutes 16 (or lanes) are full and ready to go.

The process continues to step 240 where the axis conditions of the servo-controlled walking-beam filling apparatus 107 are checked, to step 242 where the variable frequency drive conditions are checked, to step 243 where the PLC conditions are checked. All critical operating parameters (heat sink temp, voltage, current, etc.) are continually monitored. Should any parameter fall outside the acceptable range, the PLC is notified.

A failure at any of the foregoing steps results in a full system stop at step 241. If the conditions are acceptable the process continues to step 250, where the operator is given the option of changing (manually overriding) any given system parameter. If the operator does call for a parameter change, the new parameter(s) are input to the PLC at step 251, the input parameters are qualified. If acceptable, the new parameter(s) are transmitted to the relevant device(s) at step 252, the transmission is verified in a known manner at step 253. If the the new parameter(s) are not proper or are not properly sent, the operator is alerted at step 255.

Figure 24:
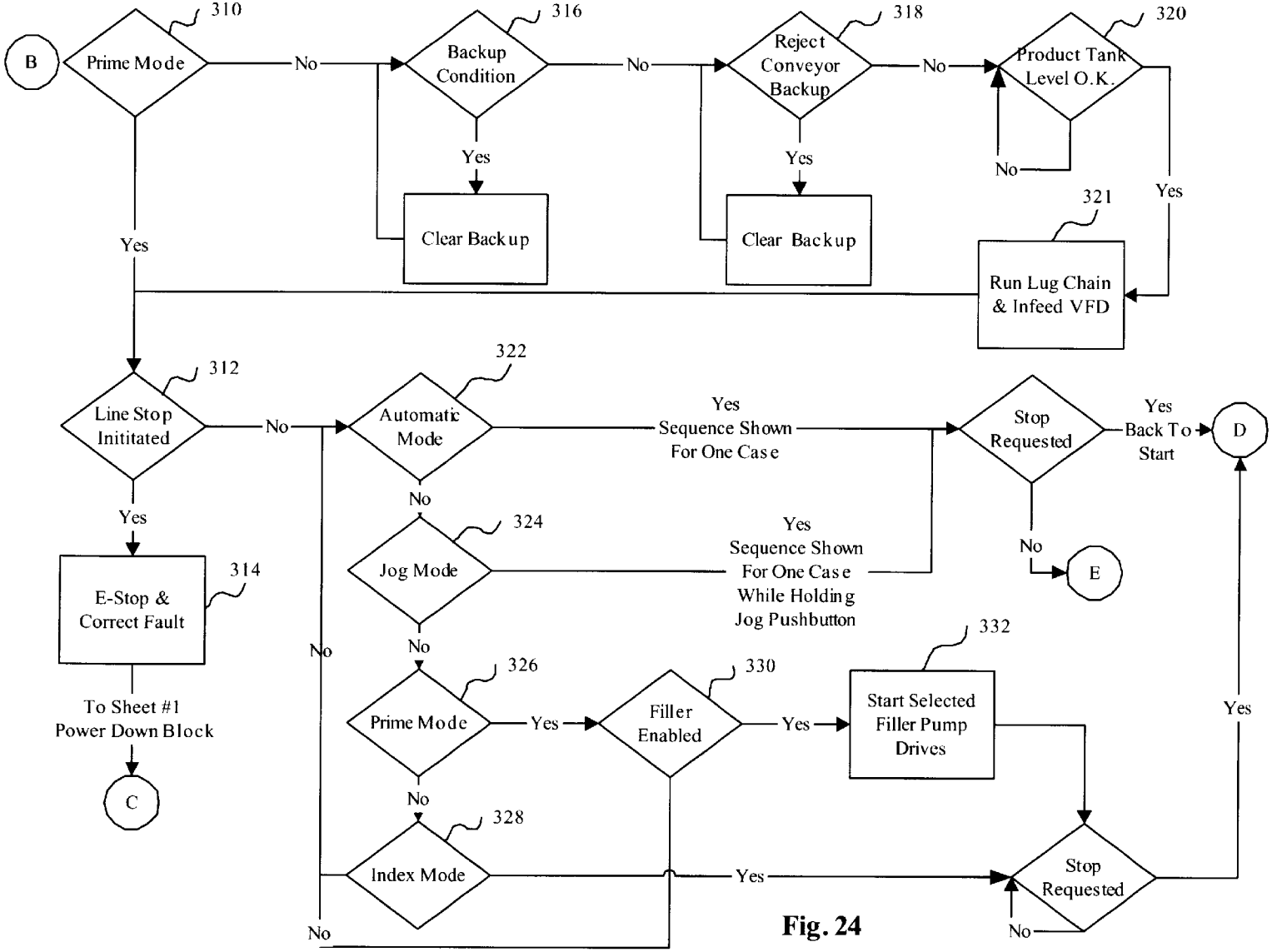

If the new parameter(s) are proper, the process moves to FIG. 24, which illustrates that present system can be run in 4 different modes, including Prime Mode for starting the filling pumps. If the system is not running in Prime Mode at step 310, the PLC performs a series of checks for backup conditions at the main conveyor 115 (step 316) and the case collection roller conveyor 5 (step 318), and ensures that the filler tanks are okay (step 320). If so, the filling apparatus 7 is enabled, the pumps are primed, and the main conveyor 115 and case indexing assembly 9 are started at step 321. If the system is running in Prime Mode at step 312, the PLC checks to see whether a line stop was initiated at step 262. If so, the system implements an emergency stop, the operator may correct the fault at step 264, and the systems completes a power down (returning to FIG. 22). Assuming that a line stop was not initiated, (i.e., the line is running) mode selection is completed (the PLC polling for the current mode), the appropriate mode's functions will be completed. Automatic mode at step 322 is the normal fully automatic mode. Jog Mode at step 324 is a one-by-one mode individually initiated by the operator. Prime mode at step 326 (and as previously described) enables the filler at step 330, starts the pumps at step 332 and then returns for operational mode selection. Index Mode at step 328 is a system calibration cycle.

Figure 25:
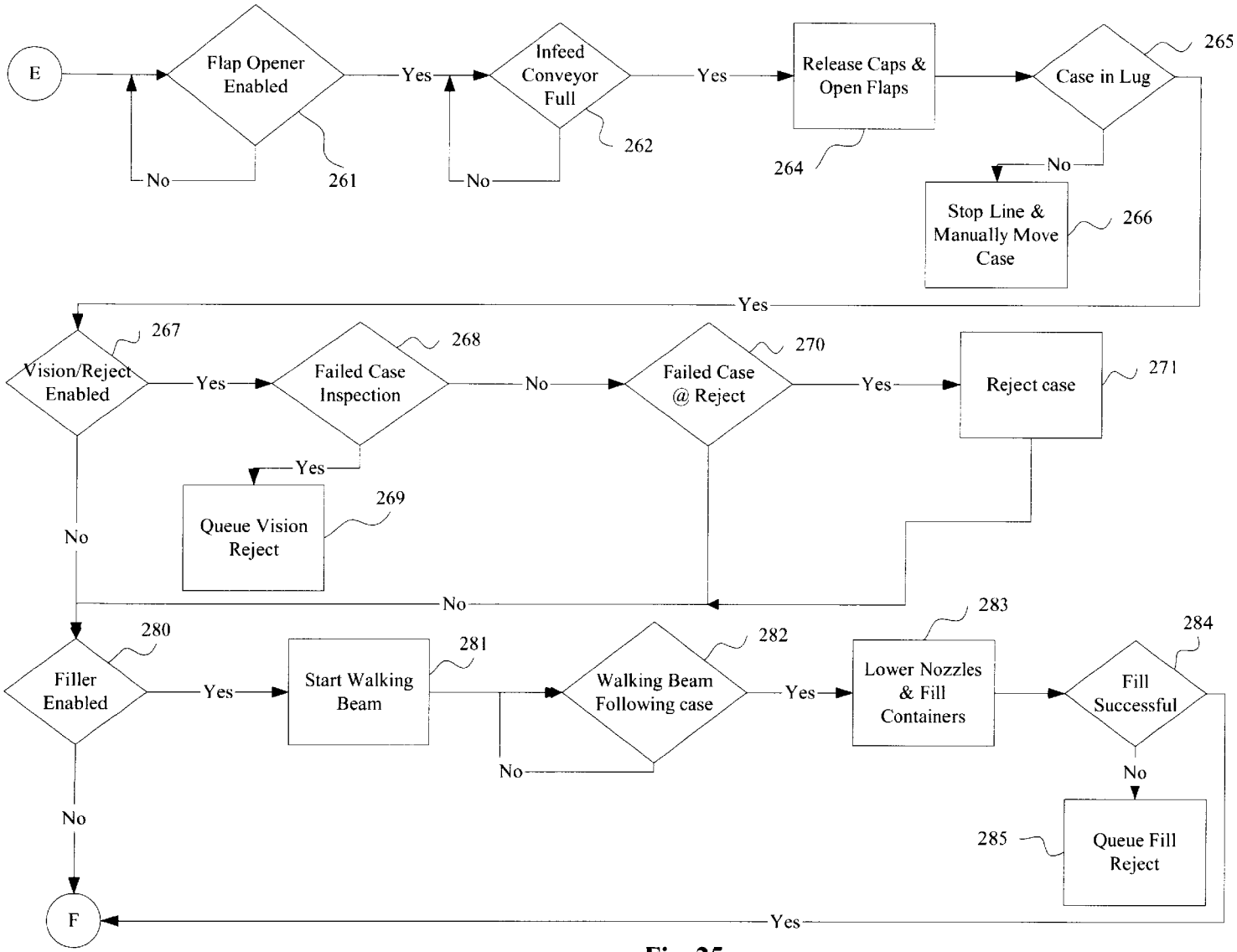

If the system is set for automatic mode and there was no stop request during the previous cycle, the process continues to FIG. 25. Here the flap opener 2 is enabled at step 261 and a check is run to ensure that the conveyor is full at step 262. This check is governed by the PLC to ensure that an adequate backlog of cases is present to enable the flap opener 2 to run correctly.

Next, the cases proceed through the flap opener 2 at step 264 which automatically opens all four flaps of the case.

Next, the PLC 23 actuates and synchronizes the downstream case drive servos at step 265 as the cases approach optical inspection station 3. If a case mis-feeds, the line is stopped at step 266 and the case may be manually repositioned Next, the optical inspection process is initiated at step 267. Here each open case is indexed into optical inspection station 3 where the vision system determines whether any containers are missing from the case, and whether any containers are not properly oriented. Cases that are improperly queued fail at optical inspection station 3 at step 268 and are rejected and are at step 269 urged off the system conveyor 15 by automatic pusher bar assembly 4, and accumulated on case collection roller conveyor 5. Defective cases also fail the optical inspection station 3 at step 270, and these are also urged off the system conveyor 15 at step 271 as above.

If the case passes at the optical inspection station 3 (or if the vision system is disabled), the case is transferred down conveyor 115, and both the case indexing assembly 9 and the servo-controlled walking-beam filling apparatus 107 are enabled at steps 280 and 281, respectively.

Figure 26:
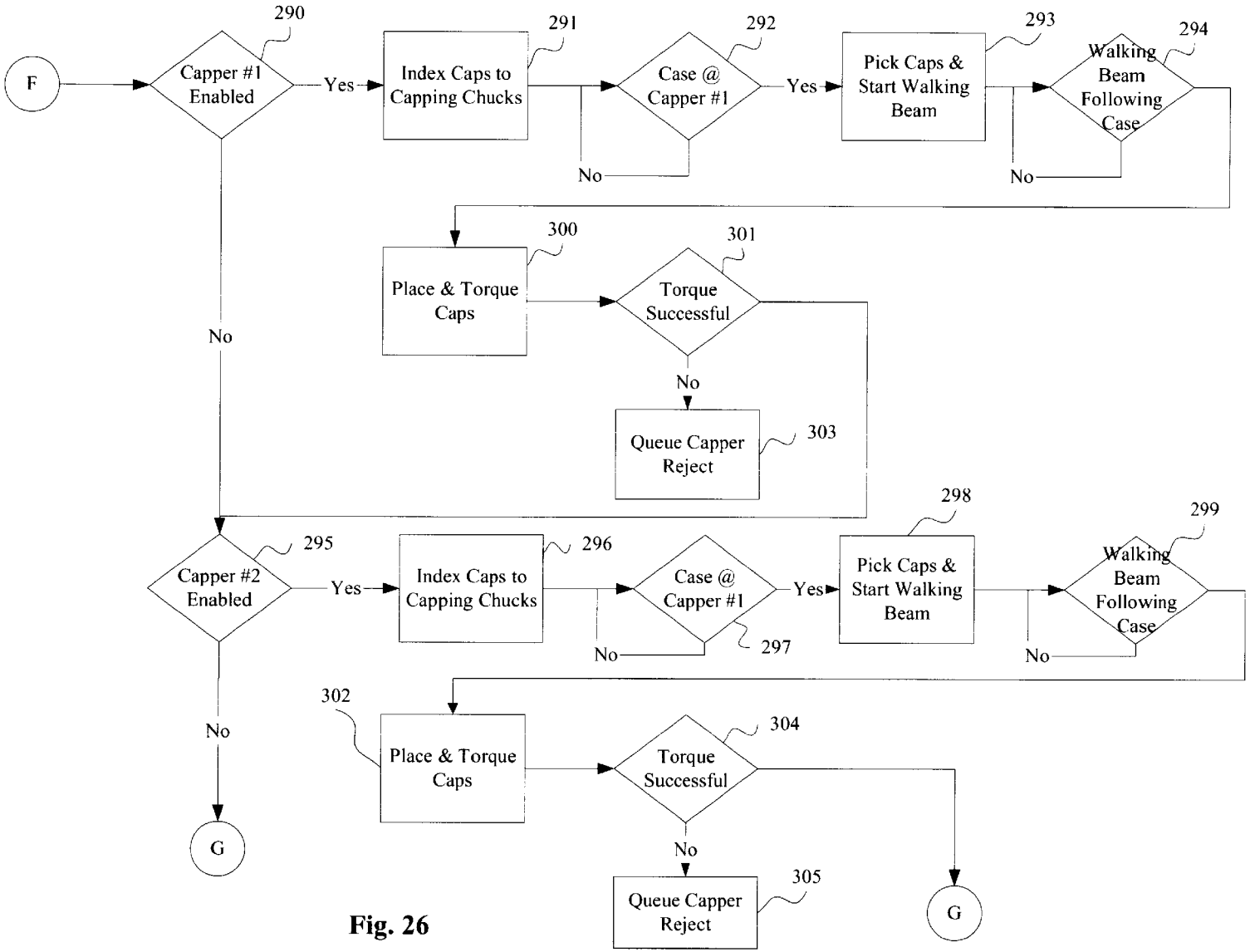

At step 282, two cases are picked up by indexing assembly 9. If the cases are properly positioned, the PLC then initiates the filling process at step 283, and the servo-controlled walking-beam filling apparatus 107 fills the containers as it tracks the continuous motion of indexing assembly 9. It should be noted that two cases are not required. The system will fill only one if there happens to be only one on the lug chain at this time. Efficiency is gained with two. At step 284 the walking beam filling apparatus 107 checks to ensure that the containers are properly filled and reports a successful fill if appropriate to the PLC, the latter being responsible for determining whether or any particular case should be rejected or not. If yes, they are rejected at step 285. Given a proper fill, the process continues to the capping stage as shown in FIG. 26.

At step 290, the PLC enables the first of the two Capamatic™ multi-spindle continuous-motion capping machines of capper assembly 150, and the first case to be transferred is indexed into the capping station at step 291 by indexing assembly 9.

In tandem with the foregoing steps, the PLC enables the second of the two Capamatic™ multi-spindle continuous-motion capping machines of capper assembly 150 at step 295, and the second case to be transferred is indexed into the capping station at step 296 by indexing assembly 9.

If the leading case is properly positioned at step 292, the indexer 9 positions the case for capping at step 293. The PLC then checks for coordination between the indexer 9 and the continuous-motion capping apparatus 150 at step 294.

The same is concurrently done for the trailing case. If the trailing case is properly positioned at step 297, the indexer 9 positions the case for capping at step 298. The PLC then checks for coordination between the indexer 9 and the continuous-motion capping apparatus 150 at step 299.

The tandem capping process is initiated at steps 300 and 302. The forward capper in assembly 150 caps the leading row of containers in the case at step 300. Upon completion, the caps are checked for errors at step 301. Simultaneous with the capping of the containers in the first case, the rear capper in assembly 150 caps the leading row of containers in the trailing case at step 302. Upon completion, the caps are checked for errors at step 304. Rejects are subject to operator intervention at steps 303 and 305, respectively. The conveyor is stopped, the operator is alerted, and the operator is responsible for deciding what to do with those particular cases. The forward and rear cappers in assembly 150 continue on to subsequent rows of containers in both cases, row by row, until the entire cases have been capped and checked for errors.

Figure 27:
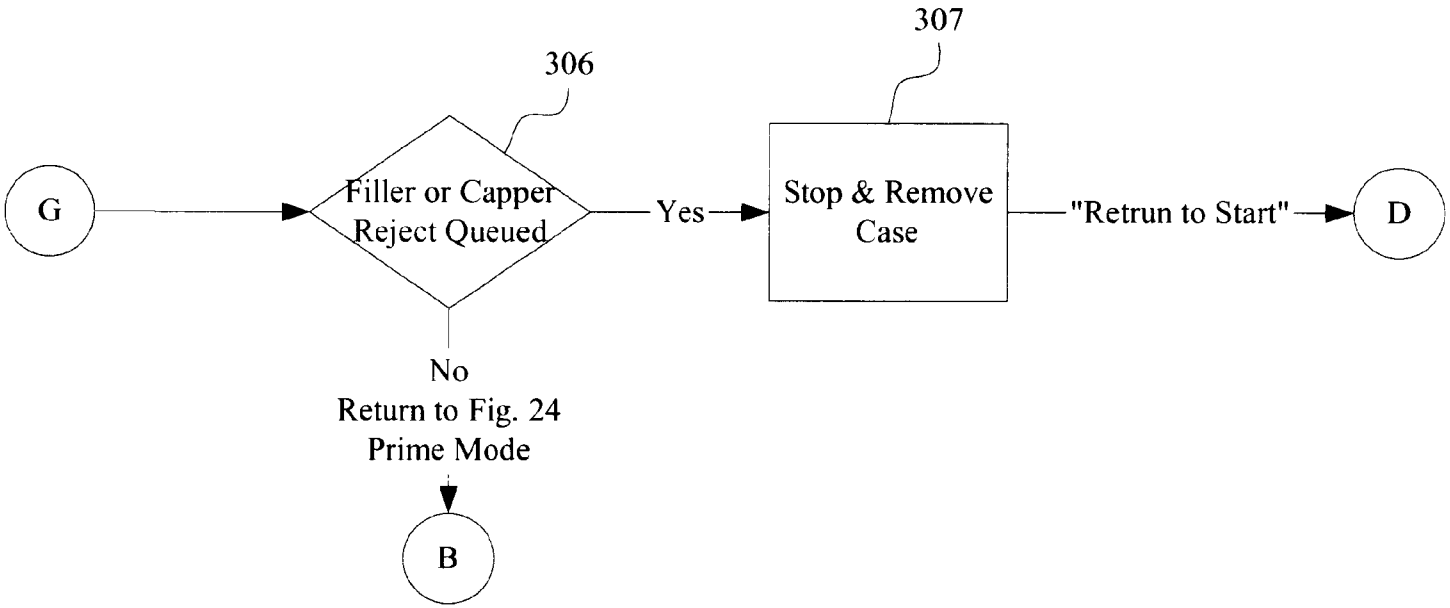

The process continues to FIG. 27, where the two fully capped cases are reject queued at step 306 and the system returns to Prime Mode at FIG. 24. This reflects the fact that the system will complete all currently engaged functions before responding to a mode change. For instance, should the operator select Prime Mode while the machine is busy filling and capping cases already in process, the machine will complete those particular functions on those particular cases before attempting to initiate the Prime Mode sequence. The selected mode is monitored continually, and the system will will respond as soon as all engaged processes are allowed to complete normally.

Assuming a successful capping operation the cases are indexed out of the cappers of capping assembly 150 at step 307, and indexer 9 initiates processing of the next pair of cases. Once the last case has been processed, the job ends.

The coordination of the servo-controlled walking-beam filling apparatus 107, and the servo-controlled continuous-motion capping functionality of the capping apparatus 150 with the indexing of the cases by indexing assembly 9, greatly improves the efficiency of both the filling and capping operations.

Having now fully set forth the preferred embodiments and certain modifications of the concept underlying the present invention, various other embodiments as well as certain variations and modifications of the embodiments herein shown and described will obviously occur to those skilled in the art upon becoming familiar with said underlying concept. It is to be understood, therefore, that the invention may be practiced otherwise than as specifically set forth in the appended claims.

We claim:

1. A multi-function in-case filling and capping system for automated high-volume filling and capping of containers in cardboard cases, comprising;

a servo-controlled indexing assembly for transporting at least two adjacent cases and for positioning said at least two cases into proper filling and capping positions;

a filling apparatus including a plurality of filling nozzles mounted on a servo-controlled walking-beam extending along said servo-controlled indexing assembly, said walking beam providing vertical and horizontal motion of said nozzles in registration with containers in all of said at least two adjacent cases and synchronous thereto while being transported by said servo-controlled indexing assembly;

a capping apparatus including a plurality of capping chucks mounted on a servo-controlled walking-beam extending along said servo-controlled indexing assembly, said walking beam providing vertical and horizontal motion of said chucks in registration with containers in all of said at least two adjacent cases and synchronous thereto while being transported by said servo-controlled indexing assembly;

a programmable controller connected to said servo-controlled indexing assembly, said filling apparatus and said capping apparatus for synchronizing the travel of the indexing assembly with the travel of the walking-beam of said filling apparatus, and with the travel of the walking-beam of said capping apparatus, the plurality of nozzles of the filling apparatus thereby tracking said at least two cases of containers along the servo-controlled indexing assembly as liquid is dispensed and said plurality of capping chucks of said capping apparatus thereby tracking said at least two cases of containers along said servo-controlled indexing assembly as caps are applied.

2. The multi-function in-case filling and capping system according to claim 1, further comprising a bar code reader mounted on said conveyor for scanning a bar code on said cases.

3. The multi-function in-case filling and capping system according to claim 1, further comprising an optical inspection station mounted on said conveyor for inspecting said cases and insuring that said containers are present and properly oriented.

4. The multi-function in-case filling and capping system according to claim 3, wherein said optical inspection station further comprises a pusher bar assembly for ejecting non-conforming cases.

5. The multi-function in-case filling and capping system according to claim 1, further comprising a flap opener for automatically opening the flaps of said case.

6. The multi-function in-case filling and capping system according to claim 1, wherein said programmable controller causes said servo-controlled indexing assembly to position and convey said pair of cases in tandem, the nozzles of the walking-beam filling apparatus thereby tracking said pair of cases of containers along the servo-driven indexing assembly as liquid is dispensed.

7. The multi-function in-case filling and capping system according to claim 1, further comprising an in-process quality control system connected to said programmable controller for automatically determining inappropriate fill volumes.

8. The multi-function in-case filling and capping system according to claim 1, wherein said programmable controller is also connected to said capping apparatus for synchronizing the travel of the servo-controlled indexing assembly to the travel of the walking-beam capping apparatus, said plurality of chucks of the walking-beam capping apparatus thereby tracking said cases of containers along the servo-controlled indexing assembly as the caps are applied.

* * * * *